US009509067B2

(12) United States Patent
Yamauchi et al.

(10) Patent No.: US 9,509,067 B2
(45) Date of Patent: Nov. 29, 2016

(54) COAXIAL ELECTRICAL CONNECTOR

(71) Applicant: DAI-ICHI SEIKO CO., LTD., Kyoto-shi (JP)

(72) Inventors: Takao Yamauchi, Tokyo (JP); Sho Suzuki, Tokyo (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/706,491

(22) Filed: May 7, 2015

(65) Prior Publication Data

US 2015/0364843 A1 Dec. 17, 2015

(30) Foreign Application Priority Data

Jun. 16, 2014 (JP) ..... 2014-123608

(51) Int. Cl.

*H01R 9/053* (2006.01)
*H01R 9/05* (2006.01)
*H01R 4/18* (2006.01)

(52) U.S. Cl.

CPC ..... *H01R 9/053* (2013.01); *H01R 9/0518* (2013.01); *H01R 4/185* (2013.01)

(58) Field of Classification Search

CPC ..... H01R 9/031; H01R 9/053; H01R 9/075; H01R 12/616; H01R 12/67; H01R 4/24; H01R 4/2404; H01R 4/2445; H01R 4/5033; H01R 4/185; H01R 9/0518

USPC ..... 439/394–398, 41, 409, 410, 423, 424, 439/427, 393, 401

See application file for complete search history.

(56) References Cited

U.S. PATENT DOCUMENTS 4,178,054 A 12/1979 Laudig
4,708,414 A 11/1987 Lam (Continued)

FOREIGN PATENT DOCUMENTS

JP 60-3565 U 1/1985
JP 60-184278 U 12/1985

(Continued)

OTHER PUBLICATIONS

Office Action issued Dec. 22, 2015 in Japanese Patent Application No. 2014-123608 (with English language translation).

(Continued)

*Primary Examiner* — Chandrika Prasad
*Assistant Examiner* — Harshad Patel
(74) *Attorney, Agent, or Firm* — Oblon, McClelland, Maier & Neustadt, L.L.P.

(57) ABSTRACT

The reliability of electrical connectivity can be improved by a simple configuration while reducing the number of processes of connection of a coaxial cable. An outer conductor and a connector main-body part are configured to be electrically connected by pushing cable rupturing parts, which are projecting toward an inner side from a radial-direction outer side of a coaxial cable placed on a connector main-body part, against the radial-direction inner side toward the coaxial cable and rupturing an outer-periphery covering material of the coaxial cable. As a result, when electrical connection with respect to the outer conductor of the coaxial cable is to be established, a connecting operation is configured to be carried out without carrying out terminal treatment processing such as a strip process of ripping off a dielectric body or an insulator surrounding a central conductor and the outer conductor so that the connecting process with respect to the outer conductor of the coaxial cable is significantly simplified.

4 Claims, 20 Drawing Sheets

(56) References Cited

U.S. PATENT DOCUMENTS

| | | | | | |
|---|---|---|---|---|---|
| 5,083,934 | A * | 1/1992 | Kawaguchi | H01R 9/053 | 439/341 |
| 5,154,632 | A * | 10/1992 | Ijiri | H01R 9/053 | 439/394 |
| 5,569,049 | A * | 10/1996 | Tatebe | H01R 24/50 | 439/394 |
| 8,876,552 | B2 * | 11/2014 | Taguchi | H01R 24/54 | 439/582 |

FOREIGN PATENT DOCUMENTS

| | | | |
|---|---|---|---|
| JP | 5-2534 | U | 1/1993 |
| JP | 7-106002 | A | 4/1995 |
| JP | 2005-183214 | | 7/2005 |
| JP | 2006-294514 | A | 10/2006 |
| JP | 2008-192369 | | 8/2008 |
| JP | 2013-097915 | | 5/2013 |
| JP | 2013-098121 | | 5/2013 |
| KR | 10-2001-0071341 | | 7/2001 |
| KR | 10-0359524 | B1 | 1/2003 |

OTHER PUBLICATIONS

Office Action mailed Jul. 11, 2016, in Korean Patent Application No. 10-2015-0054689.

* cited by examiner

COAXIAL ELECTRICAL CONNECTOR

BACKGROUND OF THE INVENTION

Field of the Invention

The present invention relates to a coaxial electrical connector that establishes electrical connection by placing and fixing a coaxial cable on/to a connector main-body part.

Description of Related Art

Generally, coaxial cables are widely used as signal transmission media in various electrical equipment such as mobile phones, smartphones, tablet-type personal computers, etc. As an electrical connector for efficiently connecting the coaxial cable to a printed wiring board, a coaxial electrical connector is often employed. The coaxial electrical connector has a structure in which, for example, a shell main-body part consisting of a hollow cylindrical-shape member is attached to an outer peripheral side of an insulating housing, wherein a shell cover part is coupled to a cylindrical opening of the shell main-body part so that the shell cover part can be opened/closed. After a central conductor caused to be in an exposed state by terminal treatment processing of the coaxial cable is set on a placement surface of a signal contact, electrical connection is established by soldering or the sandwiching force of the conductor, and the shell cover part, which has been in an open state, is pushed down and closed to complete assembly.

However, in such a conventional coaxial electrical connector the terminal treatment processing of the coaxial cable as described above is required. More specifically, before the electrical connection of the coaxial cable is established, a central conductor and an outer conductor have to be brought into an exposed state by carrying out a strip process of ripping off a dielectric body and an insulator surrounding the central conductor and the outer conductor of the coaxial cable a plurality of times (for example, three times). Connection by soldering, etc. is established after such a strip process is carried out a plurality of times. Therefore, the number of processes for establishing the connection of the coaxial cable is tend to be increased, which is a problem for improving productivity.

On the other hand, in a coaxial connector described in the below-identified patent document or other similar documents, a pair of cutting pieces forming cutting-blade shapes is pushed against an insulator of a coaxial cable in a direction orthogonal to the axis thereof so that the pair of cutting pieces cut (rupture) the insulator and contact the outer conductor and the central conductor of the coaxial cable, and electrical connection is established in the state in which the outer conductor and the central conductor are sandwiched in a gap between the paired cutting blades. According to such a coaxial connector, the processes of ripping off the insulator can be somewhat reduced to, for example, two times of the strip process. However, since productivity can be still improved more, and, since the cutting pieces are pushed in the direction orthogonal to the axis, the outer conductor and the central conductor may be cut, and there is a problem in the reliability of the connecting process.

The inventor of the present invention hereby submits Japanese Patent Application 2013-98121 as prior document related to this invention.

BRIEF SUMMARY OF THE INVENTION

Therefore, it is an object of the present invention to provide a coaxial electrical connector capable of improving the reliability of electrical connectivity by a simple configuration while reducing the number of processes for connecting the coaxial cable.

The present invention for achieving the above described object employs a coaxial electrical connector for establishing electrical connection by placing and fixing a coaxial cable on/to a connector main-body part, the coaxial cable formed so as to surround, from an outer side by an outer-periphery covering material, an outer conductor concentrically disposed with respect to a central conductor; wherein cable rupturing parts projecting from a radial-direction outer side of the coaxial cable placed on the connector main-body part toward an inner side are provided on the connector main-body part; a pair of the cable rupturing parts is disposed so as to sandwich the coaxial cable from radial-direction both sides; and the cable rupturing part is configured to rupture the outer-periphery covering material and be electrically connected to the outer conductor when the pair of cable rupturing parts is pushed to a radial-direction inner side toward the coaxial cable.

According to the present invention having such a configuration, when the electrical connection with respect to the outer conductor of the coaxial cable is to be established, electrical connection with respect to the outer conductor is established when the cable rupturing parts provided on the connector main-body part enter the radial-direction inner side while rupturing the outer-periphery covering material of the coaxial cable. Therefore, the connecting operation is carried out without carrying out terminal treatment processing of the coaxial cable, in other words, the strip process of ripping off the dielectric body and the insulator surrounding the central conductor and the outer conductor, and, since the connecting process with respect to the outer conductor of the coaxial cable is significantly simplified, productivity is improved.

Moreover, in the present invention, it is desired that the connector main-body part be provided with a shell main-body part that houses an insulating housing and a shell cover part attached to the shell main-body part so as to cover the shell main-body part; the shell main-body part be provided with a cable receiving part on which the coaxial cable is placed; a first one of the pair of cable rupturing parts be provided on the cable receiving part; and a second one of the pair of cable rupturing parts be provided on the shell cover part.

According to the coaxial electrical connector according to the present invention having such a configuration, when the shell cover part is to be attached to the shell main-body part, the closing operation of the shell cover part is carried out in the state in which the cable rupturing parts provided on the shell cover part are biting into the coaxial cable. Therefore, the coaxial cable is pulled toward the connector central side along with the closing operation of the shell cover part, and electrical connectivity is stabilized as a result.

Moreover, in the present invention, it is desired that the first one and the second one of the pair of cable rupturing parts be disposed to be mutually misaligned in an extending direction of the coaxial cable.

According to the coaxial electrical connector according to the present invention having such a configuration, the biting force of both of the cable rupturing parts, which are disposed to be mutually misaligned, with respect to the coaxial cable causes part of the coaxial cable to be in a deformed state with respect to the straight direction which is the original extending direction of the coaxial cable so that the electrical connection state is stabilized by the retaining force provided by the deformed part of the coaxial cable.

Moreover, in the present invention, the shell main-body part can be provided with a pair of cable-connecting arm parts projecting from the shell main-body part in an extending direction of the coaxial cable; the coaxial cable can be configured to be placed between the paired cable-connecting parts; and the cable rupturing parts can be provided on the paired cable-connecting arm parts, respectively.

Moreover, the shell cover part can be provided with a fixation retaining part sandwiching the coaxial cable placed on the cable receiving part; and at least part of the fixation retaining part can be swage-fixed to the cable receiving part.

Moreover, in the present invention, it is desired that a signal contact member and a ground contact member respectively connected to the central conductor and the outer conductor of the coaxial cable be attached to the insulating housing so as to form an approximately concentric shape; the signal contact member be provided with a cable connecting part connected to the central conductor of the coaxial cable and provided with a contact connecting part connected to a signal contact member of a mating counterpart connector; the cable connecting part of the signal contact member have a cable insertion piece inserted in from an end face of a terminal part of the coaxial cable along a direction of a cable axis serving as an extending direction of the coaxial cable; and a distal-end-side part in the direction of inserting the cable insertion piece be configured to be electrically connected to the central conductor in the coaxial cable.

According to the present invention having such a configuration, the electrical connection with respect to the outer conductor is established while the cable rupturing parts provided on the conductor main-body part are rupturing the outer-periphery covering material. In addition, the electrical connection of the cable connecting part of the signal contact member with respect to the central conductor of the coaxial cable is established by a process of inserting the cable insertion piece, which constitutes the cable connecting part of the signal contact member, thereinto along the cable axis direction of the coaxial cable. Therefore, in addition to simplification of the connecting process with respect to the outer conductor of the coaxial cable, the connecting process with respect to the central conductor is significantly simplified, productivity is further improved, and the risk of cutting the central conductor of the coaxial cable is reduced.

As described above, in the present invention, with respect to the coaxial cable placed on the connector main-body part, the outer conductor and the connector main-body part are configured to be electrically connected by rupturing the outer-periphery covering material of the coaxial cable by pushing the cable rupturing parts, which are provided on the connector main-body part so as to project from the radial-direction outer side of the coaxial cable toward the inner side, toward the coaxial cable along the radial-direction inner side. When the electrical connection with respect to the outer conductor of the coaxial cable is to be established, the connecting operation is carried out without carrying out the terminal treatment processing of the coaxial cable, in other words, the strip process of ripping off the dielectric body and the insulator surrounding the central conductor and the outer conductor. Since the connecting process with respect to the outer conductor of the coaxial cable is configured to improve productivity by significant simplification. Therefore, the reliability of electrical connectivity can be improved by a simple configuration while reducing the number of processes for connecting the coaxial cable, and the reliability of the coaxial electrical connector can be significantly improved at low cost.

BRIEF DESCRIPTION OF THE DRAWINGS

FIGS. 13A and 13B show a signal contact used in the coaxial electrical connector (plug connector) shown in FIG. 1 to FIG. 12; wherein FIG. 13A is an explanatory external perspective view showing the signal contact from a front upper side, and FIG. 13B is an explanatory external perspective view of a state in which the signal contact is turned over upside down;

FIGS. 14A and 14B show the signal contact shown in FIG. 13; wherein FIG. 14A is an explanatory lateral view, and FIG. 14B is an explanatory bottom view;

FIG. 17 is inserted;

DETAILED DESCRIPTION OF THE INVENTION

Figure 1:
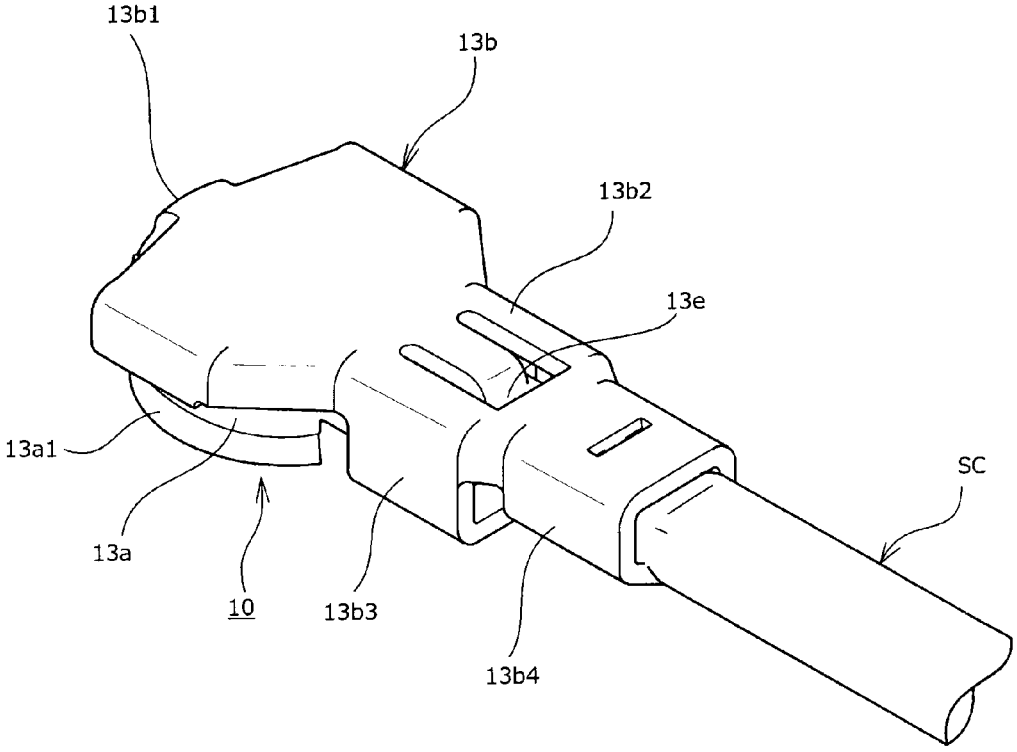
FIG. 1 is an explanatory external perspective view showing a state in which a coaxial cable is coupled to a coaxial electrical connector (plug connector) according to a first embodiment of the present invention.
Figure 2:
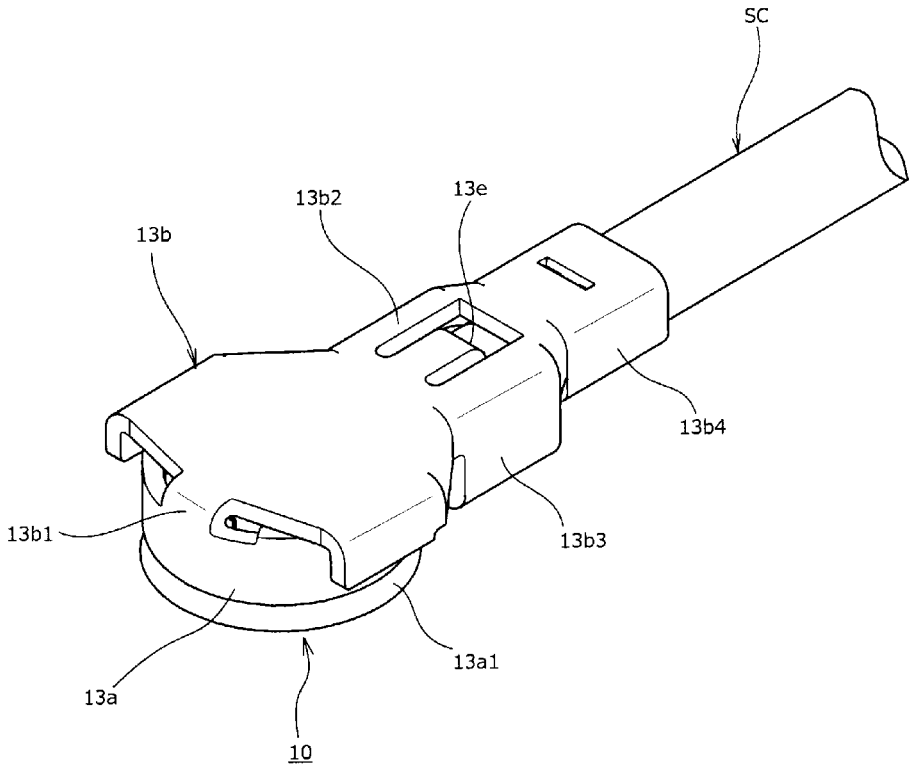
FIG. 2 is an explanatory external perspective view showing, from a back upper side, the coaxial electrical connector (plug connector) in the state shown in FIG. 1 in which the coaxial cable is coupled thereto.
Figure 3:
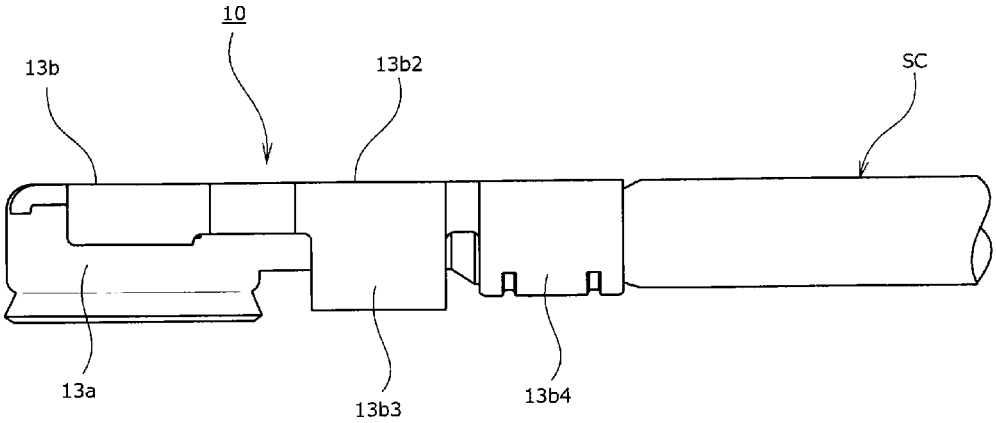
FIG. 3 is an explanatory lateral view showing the coaxial electrical connector (plug connector) in the state shown in FIG. 1 and FIG. 2 in which the coaxial cable is coupled thereto.
Figure 4:
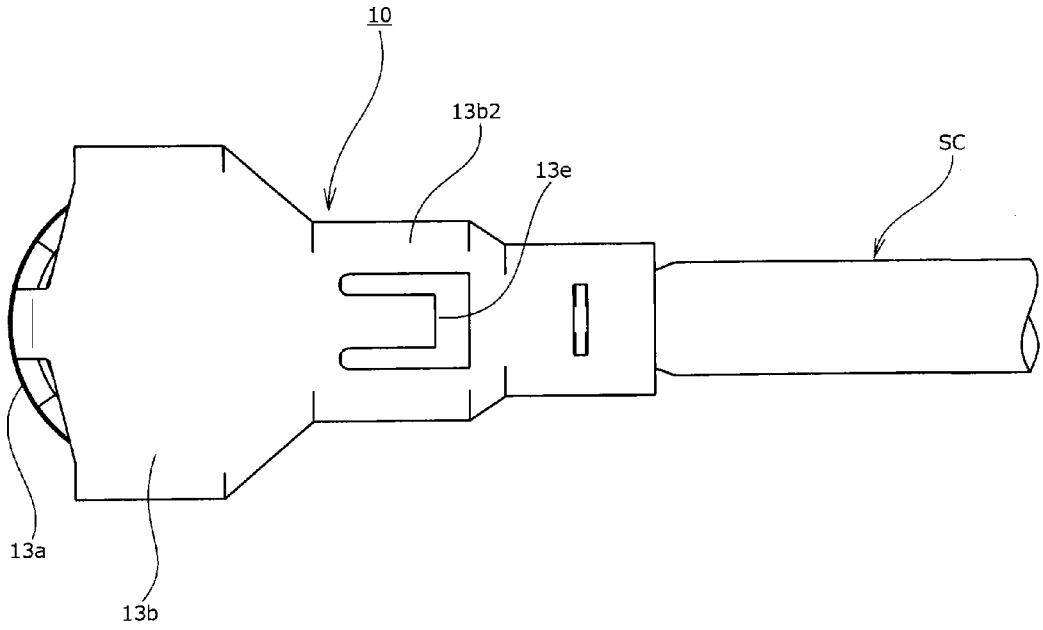
FIG. 4 is an explanatory plan view showing the coaxial electrical connector (plug connector) in the state shown in FIG. 1 to FIG. 3 in which the coaxial cable is coupled thereto.
Figure 5:
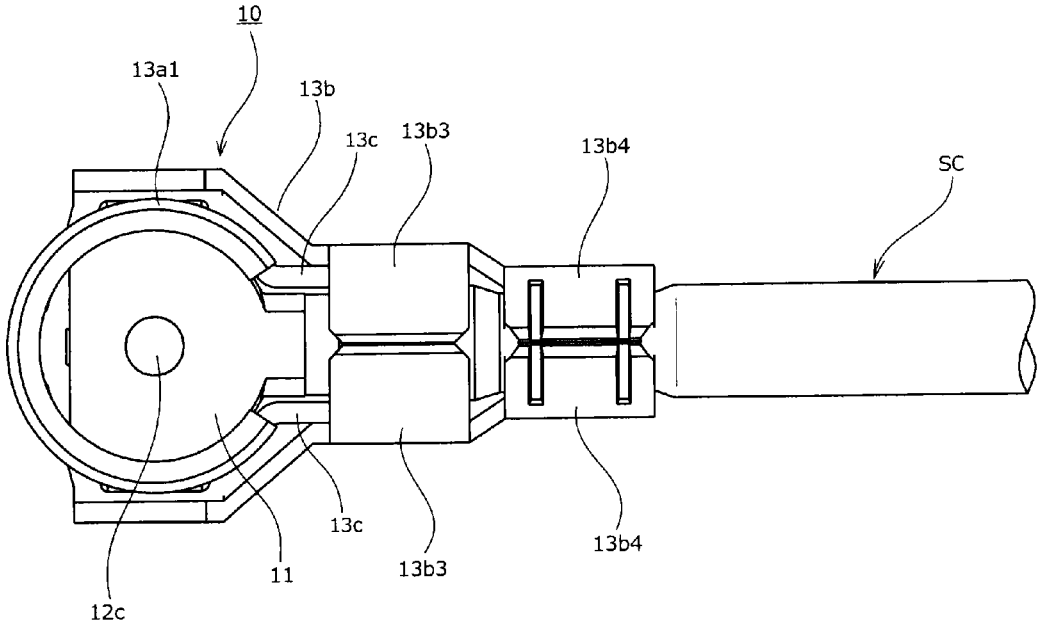
FIG. 5 is an explanatory bottom view showing the coaxial electrical connector (plug connector) in the state shown in FIG. 1 to FIG. 4 in which the coaxial cable is coupled thereto.
Figure 6:
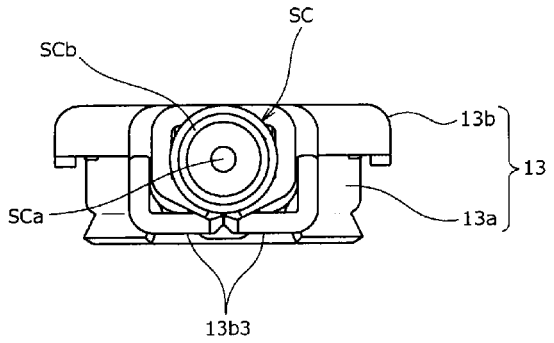
FIG. 6 is an explanatory front view showing the coaxial electrical connector (plug connector) in the state shown in FIG. 1 to FIG. 5 in which the coaxial cable is coupled thereto.

Hereinafter, an embodiment in which the present invention is applied to a coaxial electrical connector using a coaxial cable as a signal transmission medium will be explained in detail based on drawings.

Overall Structure of Coaxial Electrical Connector in First Embodiment

First, a plug connector 10 serving as a coaxial electrical connector according to a first embodiment of the present invention shown in FIG. 1 to FIG. 12 is configured to be used in a state in which a terminal part of a coaxial cable SC serving as a cable-shaped transmission medium is coupled, and the plug connector 10 is configured to be mated with a receptacle connector 20 (see FIG. 19 to FIG. 23), which is serving as a counterpart electrical connector mounted on a predetermined printed wiring board, so as to be inserted from the upper side or removed therefrom. The mating/removing operation of the plug connector 10 with respect to the receptacle connector 20, which is an example of a counterpart connector of the mating, is carried out in the direction approximately orthogonal to the plane of the printed wiring board.

More specifically, a connector main-body part constituting a main mating part of the plug connector 10 is formed so as to form a cylindrical shape as an approximate shape, the terminal part of the coaxial cable SC is coupled to the connector main-body part of the plug connector 10, which forms the approximately cylindrical shape, from one direction of a radial-direction outer side, and the coaxial cable SC is coupled thereto; in this state, the plug connector 10 is disposed so as to face a position above the receptacle connector 20 serving as the counterpart connector. Then, when the whole plug connector 10 is moved down in the direction approximately orthogonal to the outer surface of the printed wiring board, a lower end part of the plug connector 10 is brought into the state that the part is mated with an upper-side part of the receptacle connector (counterpart connector) 20 (see FIG. 21 to FIG. 23). When the mated state in which the plug connector 10 is inserted into the receptacle connector 20 in this manner is obtained, the terminal part of the coaxial cable SC is connected to a wiring-pattern electrically-conductive path on the printed wiring board via the plug connector 10 and the receptacle connector 20.

Herein, the direction in which the plug connector 10 is inserted to the receptacle connector (counterpart connector) 20 is referred to as "downward direction", and the removing direction in which, reversely, the plug connector 10 is removed is referred to as "upward direction". Moreover, the part of the plug connector 10 per se to which the terminal part of the coaxial cable SC is connected is referred to as "front-side part", and the part in the opposite side thereof is referred to as "back-side part". Furthermore, the direction from the "back-side part" toward the "front-side part" is referred to as "connector front direction", and the reverse direction thereof is referred to as "connector rear direction". Moreover, the direction orthogonal to both of the "connector top-bottom direction" and "connector front-rear direction" is referred to as "connector left-right direction".

About Coaxial Cable

Figure 15:
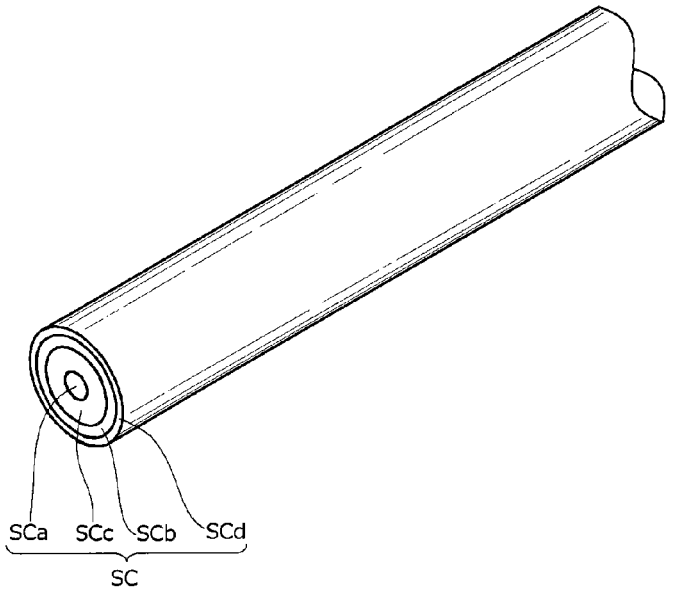
FIG. 15 is an explanatory external perspective view showing an example of the coaxial cable used in the coaxial electrical connector (plug connector) shown in FIG. 1 to FIG. 12.

Particularly as shown in FIG. 15, in the above described coaxial cable SC, a cable outer conductor (shield wire) SCb is concentrically stacked on the outer peripheral side of a cable central conductor (signal wire) SCa, which is formed by a plurality of thin conductor wires, via a cable dielectric body SCc, and an outer-periphery covering material SCd is attached to the cable outer conductor (shield wire) SCb. With respect to the terminal part of the coaxial cable SC consisting of such a concentric multi-layer structure, connection to the plug connector 10 is carried out in a state in which the terminal part has not been subjected to conventional terminal processing, in other words, an original state in which rip-off (peel-off) of the outer-periphery covering material SCd, the cable dielectric body SCc, and the cable outer conductor (shield wire) SCb has not been carried out. This point will be explained later in detail.

When the cable central conductor SCa extending along the central axis of the coaxial cable SC in the above described manner is connected to a signal contact member 12, which is attached to an insulating housing 11, along a cable axial direction of the cable central conductor SCa in a later-described manner, a signal transmission circuit is formed. Moreover, a shield shell 13, which also serves as a ground contact member, is connected in a later-described manner to the cable outer conductor SCb, which is disposed so as to surround the outer peripheral side of the cable central conductor SCa, and the shield shell 13 functions as a ground contact member for grounding; as a result, a ground circuit is formed. The configuration about the connection of the coaxial cable SC with respect to the plug connector 10 will be explained later in detail as a main part of the present invention.

About Insulating Housing

Figure 7:
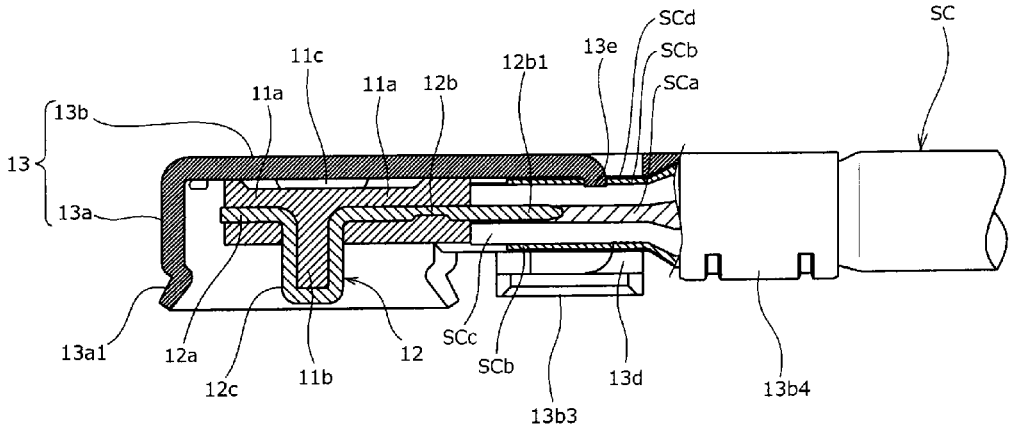
FIG. 7 is an explanatory vertical cross-sectional view of the coaxial electrical connector (plug connector) in the state shown in FIG. 1 to FIG. 6 in which the coaxial cable is coupled thereto.
Figure 8:
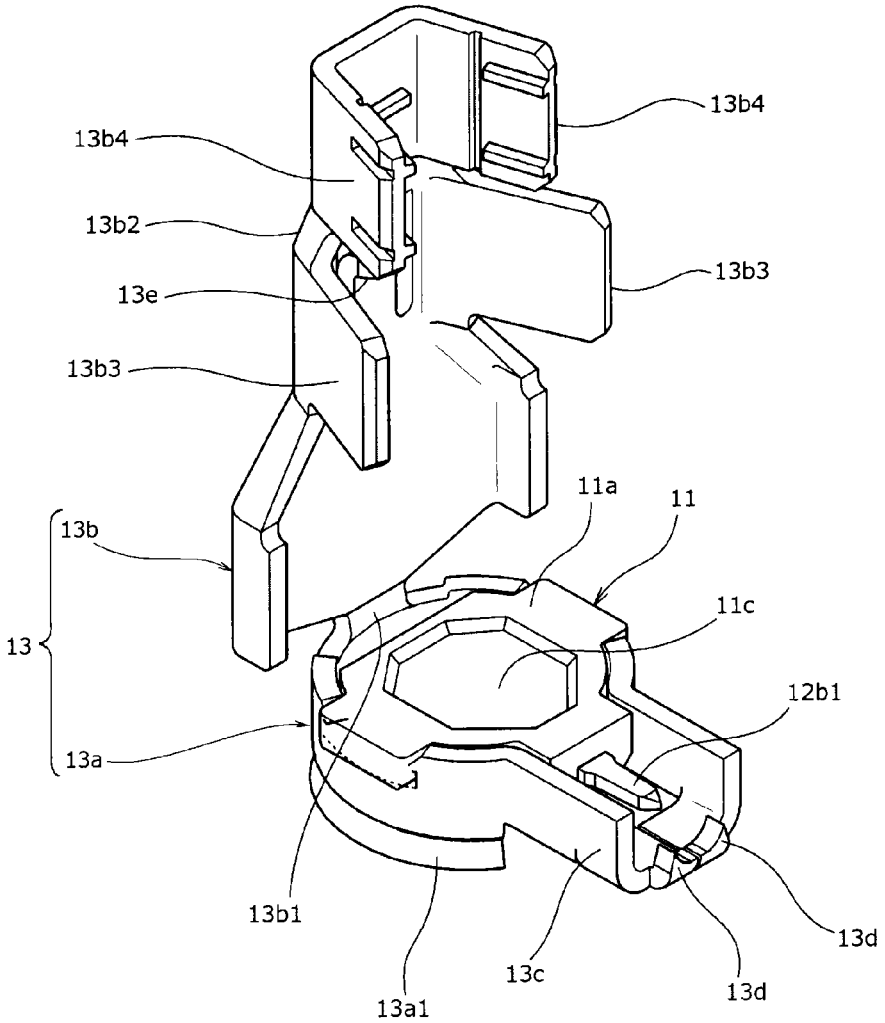
FIG. 8 is an explanatory external perspective view showing, from a front upper side, an initial state before the coaxial cable is coupled to the coaxial electrical connector (plug connector) shown in FIG. 1 to FIG. 7.
Figure 9:
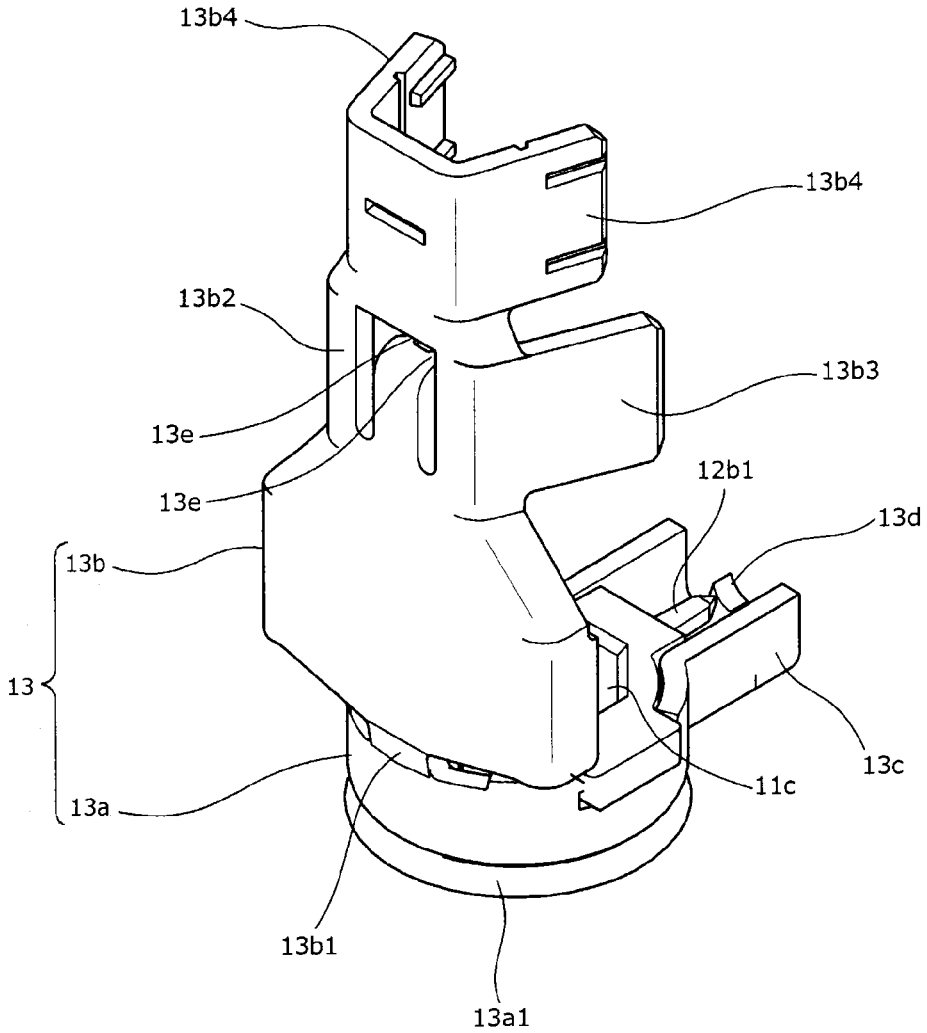
FIG. 9 is an explanatory external perspective view showing, from a back upper side, the coaxial electrical connector (plug connector) in the initial state shown in FIG. 8.
Figure 10:
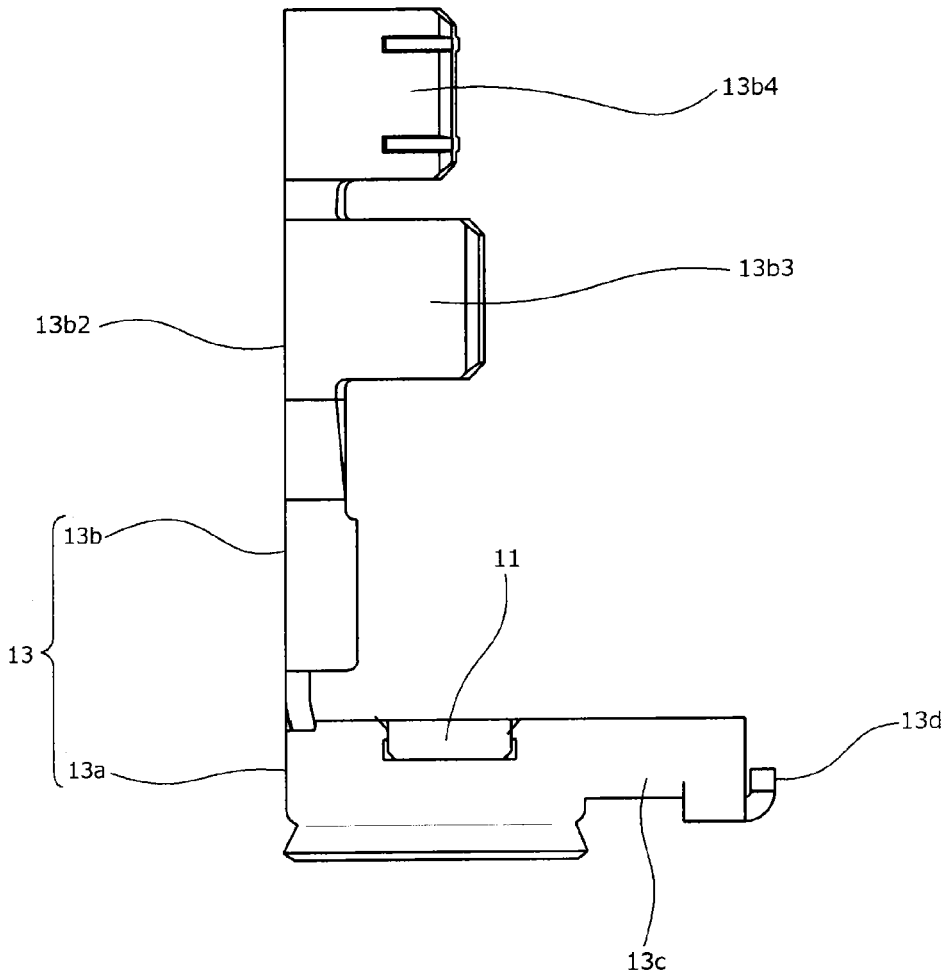
FIG. 10 is an explanatory lateral view of the coaxial electrical connector (plug connector) in the initial state shown in FIG. 8 and FIG. 9.
Figure 11:
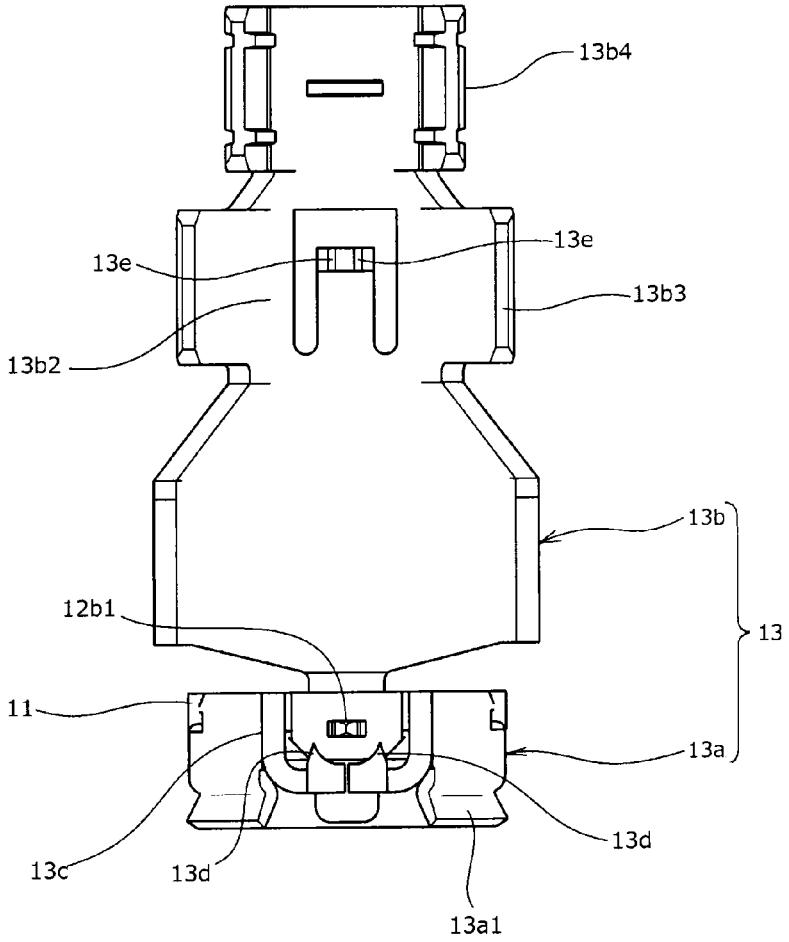
FIG. 11 is an explanatory front view of the coaxial electrical connector (plug connector) in the initial state shown in FIG. 8 and FIG. 9.
Figure 12:
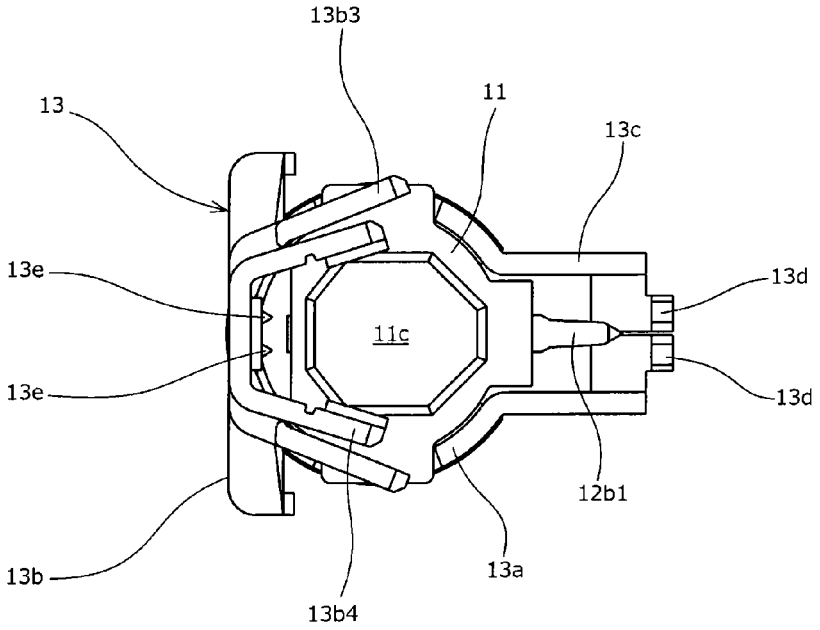
FIG. 12 is an explanatory plan view of the coaxial electrical connector (plug connector) in the initial state shown in FIG. 8 and FIG. 9.

Herein, particularly as shown in FIG. 7 and FIG. 8, the above described insulating housing 11 has an insulating main-body part 11*a* having an approximately disk shape, and an insulating insertion part 11*b*, which is inserted to the inner side of the receptacle connector 20 serving as a mating counterpart, is integrally provided with an approximately central part of the insulating main-body part 11*a* so as to project downward to form an approximately cylindrical shape. Part of a fixed part of the signal contact member 12, which will be described later, is buried in the insulating main-body part 11*a*.

An impedance matching part 11*c* is provided to be recessed on the upper surface of the insulating main-body part 11*a*, in which the signal contact member 12 is buried, so that the upper surface of the insulating main-body part 11*a* is dented. The impedance matching part 11*c* in the present embodiment is formed so as to form a recessed part having a multiangular shape in a plane and configured so as to form an air layer having a predetermined size between there and the inner surface of a later-described shell cover part 13*b*, thereby carrying out impedance matching in signal transmission. The impedance matching in this process is carried out by appropriately adjusting the size and depth of the recessed part, which forms the above described impedance matching part 11*c*, in accordance with the conditions of signal transmission.

About Signal Contact Member

Figure 13A:
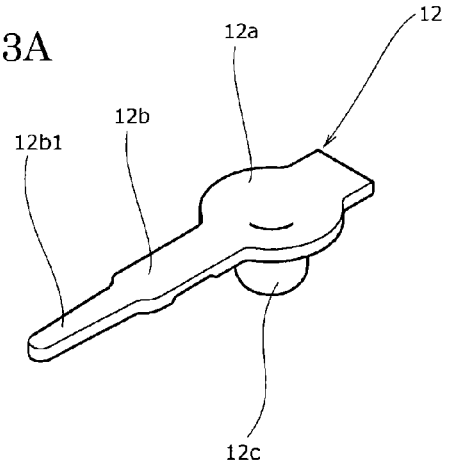
Figure 13B:
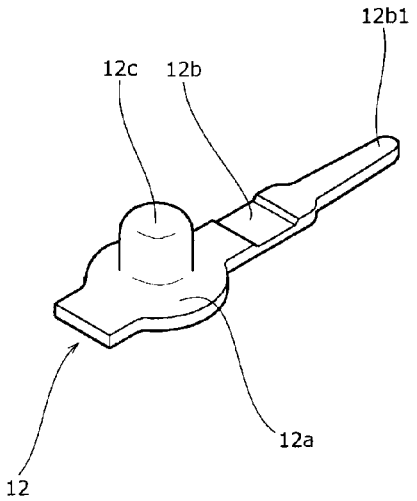
Figure 14A:
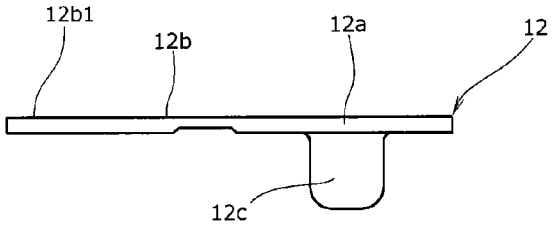
Figure 14B:
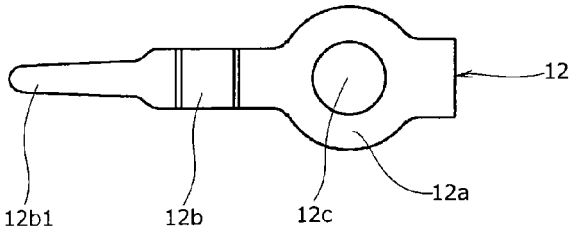

The signal contact member 12 employed in the present embodiment has an overall structure particularly as shown in FIG. 13 and FIG. 14 and is attached to the insulating main-body part 11*a* of the above described insulating housing 11 by, for example, insert molding. A contact main-body plate 12*a*, which is a main body part of the signal contact member 12, is buried in a central part of the insulating main-body part 11*a*. The contact main-body plate 12*a* is formed so as to form a disk shape having an outer diameter slightly smaller than that of the insulating main-body part 11*a*.

A cable connecting part 12*b*, which is inserted in the above described coaxial cable SC, is integrally continued to a connector-front-side part of the contact main-body plate 12*a*. The cable connecting part 12*b* is formed by a thin-plate-shaped projecting member, which is extended approximately horizontally from the contact main-body plate 12*a* toward the connector front side, and an extended-direction distal end part (left-side part in FIG. 14) of the cable connecting part 12*b* constitutes a cable insertion piece 12*b*1, which is formed to be narrow. The cable insertion piece 12*b*1 has an arrangement relation that the cable insertion piece 12*b*1 forms a needle shape and projects from the connector-front-end face of the above described insulating main-body part 11*a* toward the front side (right side in FIG. 7), and the cable insertion piece 12*b*1 is configured to be connected to the cable central conductor (signal wire) SCa when inserted into the coaxial cable SC.

Figure 16:
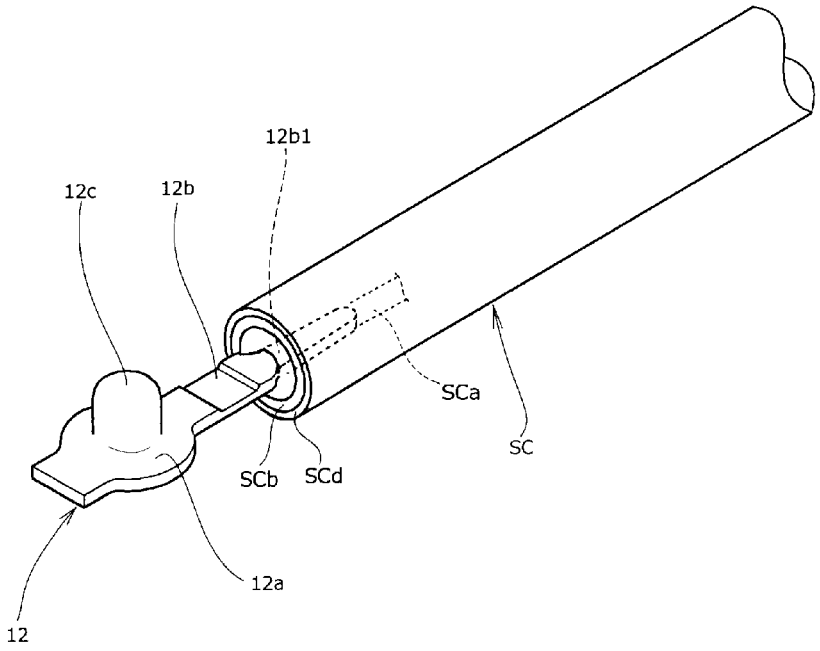
FIG. 16 is an explanatory external perspective view showing a state in which a cable connecting part of the signal contact according to the embodiment of the present invention is inserted in the coaxial cable shown in FIG. 15.
Figure 17:
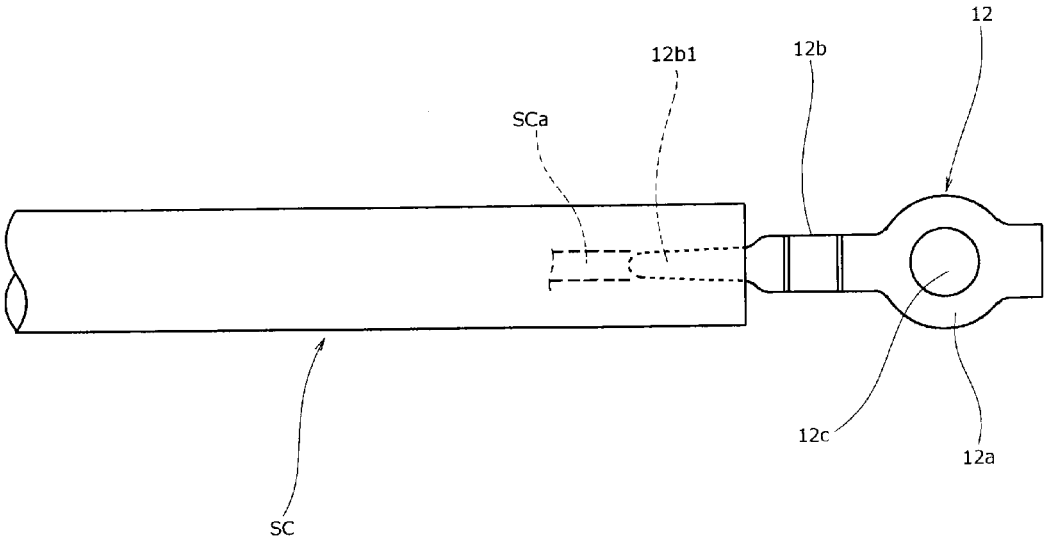
FIG. 17 is an explanatory bottom view of the coaxial cable into which the cable connecting part of the signal contact shown in FIG. 16 is inserted.
Figure 18:
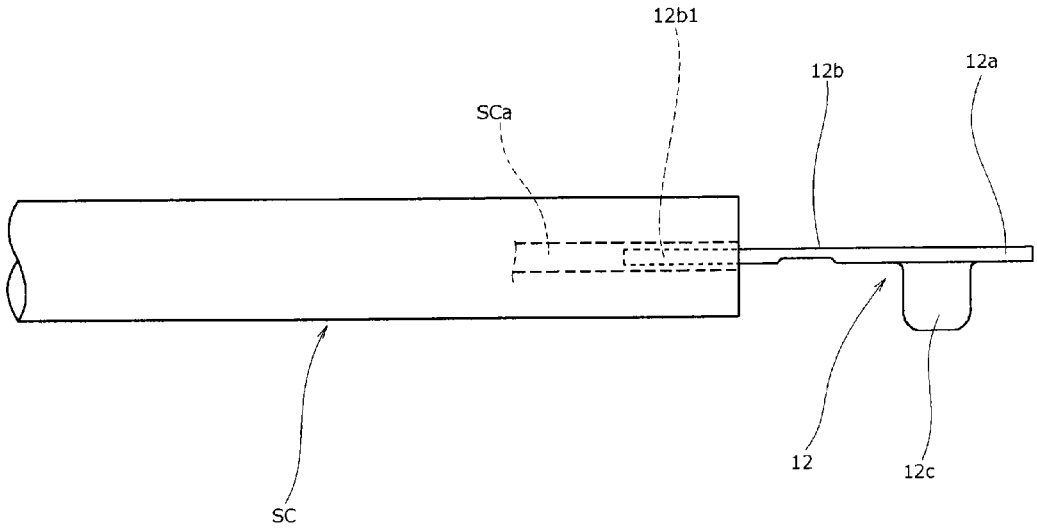
FIG. 18 is an explanatory lateral view of the coaxial cable into which the cable connecting part of the signal contact shown in FIG. 16
Figure 19:
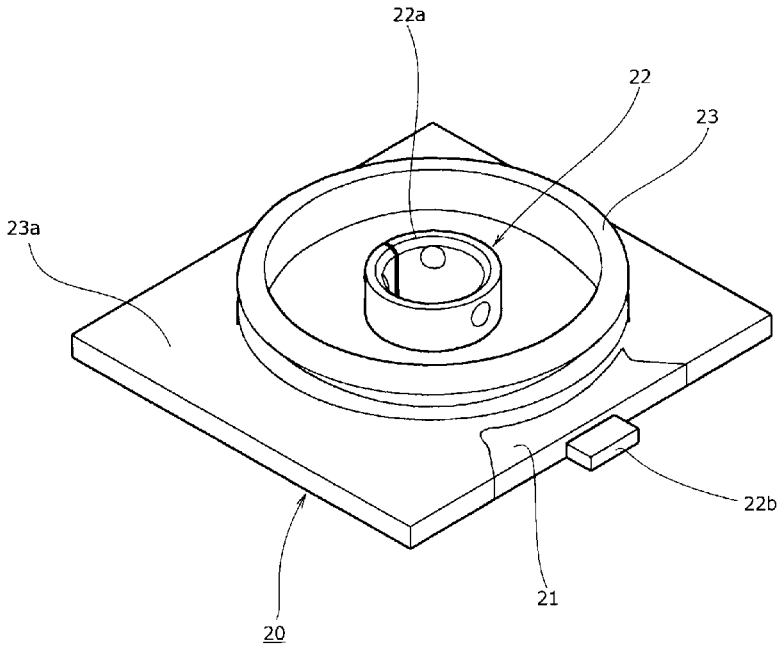
FIG. 19 is an explanatory external perspective view showing an example of an electrical connector (receptacle connector) of a counterpart side mated with the coaxial electrical connector (plug connector) according to the embodiment of the present invention.
Figure 20:
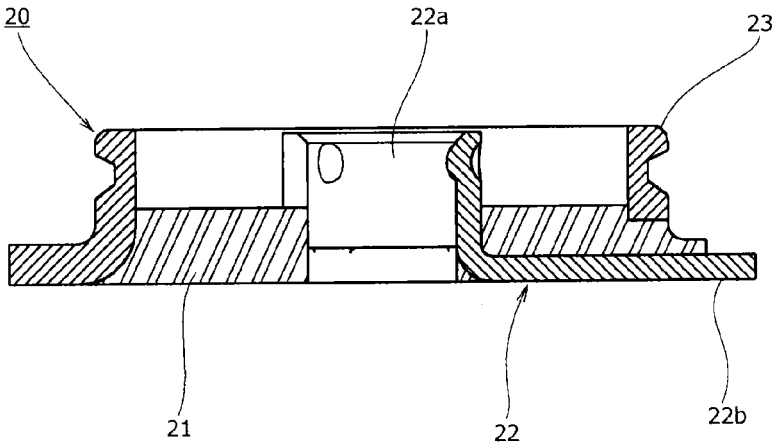
FIG. 20 is an explanatory vertical cross-sectional view of the electrical connector (receptacle connector) of the counterpart side shown in FIG. 19.

More specifically, since the cable central conductor (signal wire) SCa in the present embodiment is configured to be, for example, a bundle of a plurality of fine wires, the cable central conductor SCa is in a state in which the cable insertion piece 12*b*1 of the above described signal contact member 12 can easily enter the interior of the cable central conductor (signal wire) SCa. When the cable insertion piece 12*b*1 of the above described signal contact member 12 is inserted into an end face of the unprocessed-state coaxial cable SC, which has not been subjected to terminal processing such as peel-off as shown in FIG. 15, along the cable axial direction which is the extending direction of the coaxial cable SC, the cable insertion piece 12*b*1 of the signal contact member 12 is moved so as to enter among the plurality of fine wires constituting the cable central conductor (signal wire) SCa as shown in FIG. 16 to FIG. 18, and both of them are brought into an electrically contacted state.

In this manner, the cable insertion piece 12*b*1 of the signal contact member 12 is inserted, with no problem, into the terminal part of the unprocessed-state coaxial cable SC, which has not been subjected to a strip process of ripping off the cable dielectric body SCd and the outer-periphery covering material SCd surrounding the cable central conductor (signal wire) SCa and the cable outer conductor (shield wire) SCb, and a good contact state is obtained.

On the other hand, at a center part of the contact main-body plate 12*a* having a disk shape as described above, a contact connecting part 12*c* having a hollow cylindrical shape is disposed so as to project downward. The contact connecting part 12*c* has a hollow pin shape covering the insulating insertion part 11*b* of the above described insulating housing 11 from the outer side and is in an exposed state so that the contact connecting part 12*c* is projecting downward from the above described insulating main-body part 11*a*. The contact connecting part 12*c* provided in the side of the plug connector 10 is configured to elastically contact a contact connecting part 22*a* of the side of the receptacle connector 20 when the plug connector 10 is mated with the receptacle connector (counterpart connector) 20. The structure of the receptacle connector 20 will be described later.

About Shield Shell

The outer surface of the insulating housing 11, which has the above described insulating main-body part 11*a* and the insulating insertion part 11*b*, is covered by a shell main-body part 13*a*, which constitutes a main mating part of the shield shell 13 serving as a ground contact member consisting of a metal-thin-plate-shaped member. The shell main-body part 13*a* has an approximately hollow cylindrical shape formed so as to annularly cover the insulating main-body part 11*a* of the insulating housing 11 from the radial-direction outer side. Furthermore, a lower-side part of the shell main-body part 13*a* is formed into a shell insertion part 13*a*1, which is mated with the receptacle connector (counterpart connector) 20 from the outer side, and a shell cover part (ground cover part) 13*b* covering the upper surface side of the above described insulating main-body part 11*a* is coupled to an upper-end-side cylindrical opening part of the shell main-body part 13*a* so that the shell cover part 13*b* can be opened/closed.

At this point, particularly as shown in FIG. 8 to FIG. 12, the shield shell 13 in an initial state before the terminal part of the coaxial cable SC is fixed is in a state that the shell cover part 13*b* is open to the upper side with respect to the above described shell main-body part 13*a*. More specifically, the shell cover part 13*b* in the initial state is disposed at a rear-side edge part of the shell main-body part 13*a* via a connecting member 13*b*1, which consists of a narrow plate-shaped member, so as to rise toward an approximately vertically upper side. The installed position and the installed number of the connecting member(s) 13*b*1 can be arbitrarily selected.

Then, in this open state (initial state) of the shield shell 13, the cable insertion piece 12*b*1 of the signal contact member 12 is inserted into the terminal part of the coaxial cable SC to obtain a connected state as described above; as a result, the terminal part of the coaxial cable SC is brought into a set state with the plug connector 10. Then, when the shell cover part 13*b* is pushed down to an approximately horizontal state so that the connecting member 13*b*1 of the shield shell 13 is bent approximately at a right angle toward the lower side, as a result, the shell main-body part 13*a* and the insulating main-body part 11*a* are covered by the shell cover part 13*b* from the upper side, and the shield shell 13 is brought into a closed state (see FIG. 1 to FIG. 7).

The shell cover part 13*b* has a covering structure so that, when the shell cover part 13*b* at this point is pushed down to the approximately horizontal state and closed in the above described manner, the shell cover part 13*b* covers the cylindrical opening part in the upper end side of the shell main body 13*a*; wherein, a front-side cover part 13*b*2, which covers the coaxial cable SC from the upper side, is integrally continued to a front-side part of the shell cover part 13*b*2, which has been pushed down to the approximately horizontal state. The front-side cover part 13*b*2 is configured to cover the connector front-side part of the above described shell main-body part 13*a* from the upper side, and a cable receiving part 13*c*, which is projecting from the shell main-body part 13*a*, is provided at the connector front-side part of the shell main-body part 13*a*. The cable receiving part 13*c* is extended so as to form a structure which is open to the upper side, and the terminal part of the coaxial cable SC is configured to be placed in the inner space of the cable receiving part 13*c*, which forms this structure, from the upper side. The upper-side opening part of the cable receiving part 13*c*, which forms this structure, is covered from the upper side by the front-side cover part 13*b*2 of the shell cover part 13*b* in the above described manner.

More specifically, the cable receiving part 13*c*, which forms the above described structure, is formed so as to project in a cantilever shape from the opening provided in the front-side part of the shell main-body part 13*a* toward the connector front side to form an approximately U-shape in a front side, and the interior space formed by the cable receiving part 13*c* and having an approximately U-shape in a cross section is extended approximately horizontally along the connector front-rear direction. The cable insertion piece 12*b*1 of the signal contact member 12, which is projecting from the above described insulating main-body part 11*a*, is disposed so as to project approximately horizontally to the interior space of the cable receiving part 13*c*, and the terminal part of the coaxial cable SC, which is coupled to the cable insertion piece 12*b*1, is similarly disposed so as to be approximately horizontally extended. More specifically, the cable receiving part 13*c* is extended so as to be along the outer surface of the lower half side of the terminal part of the coaxial cable SC, which is coupled to the cable insertion piece 12*b*1, and the inner wall surface forming the interior space of the cable receiving part 13*c* is disposed so as to cover the outer-periphery covering material SCd of the coaxial cable SC from three sides, i.e., left-right-direction both sides and the lower side.

About Configuration of Cable Rupture Parts

Moreover, on the inner wall surface which forms the interior space of the above described cable receiving part 13*c*, first cable rupturing parts 13*d*, 13*d* consisting of a pair of projection-shaped parts are provided at an extending-direction distal-end part of the cable receiving part 13*c*. The paired projection-shaped parts constituting the first cable rupturing parts 13*d*, 13*d* are formed so as to project upward from the bottom-surface part of the inner wall surface of the above described cable receiving part 13*c* while forming approximately chevron shapes in a front side toward the coaxial cable SC and are juxtaposed so as to form approximately symmetrical shapes in the connector left-right direction with respect to the cable center. An apex part of the chevron shape forming the projection-shaped part of each of the first cable rupturing parts 13*d* is formed so as to form a cutting-blade shape, and the cutting-blade-shaped part of the first cable rupturing part 13*d* is in an arrangement relation that it is close to and faces the outer-periphery covering material SCd of the coaxial cable SC from the radial-direction lower side.

Then, when the shell cover part 13*b*, which has been pushed down to the approximately horizontal state in the above described manner, covers the cable receiving part 13*c* from the upper side, the coaxial cable SC is pushed in toward the lower side by the inner surface of the shell cover part 13*b*, and the pair of first cable rupturing parts 13*d*, 13*d* closely disposed in the lower side of the coaxial cable SC is configured to abut the outer peripheral surface of the coaxial cable SC, in other words, the outer-periphery covering material SCd from the radial-direction outer side (lower side).

Furthermore, the front-side cover part 13*b*2, which is continued to the shell cover part 13*b*, is provided with a pair of second cable rupturing parts 13*e*, 13*e*. The second cable rupturing parts 13*e*, 13*e* are formed in an approximately central region of the front-side cover part 13*b*2 so as to cut and raise part of the front-side cover part 13*b*2 to form hook shapes toward the connector inner side, in other words, toward the lower side in the state in which the shell cover part 13*b* is closed. Similarly to the above described first cable rupturing parts 13*d*, the second cable rupturing parts 13*e* are also formed by projection-shaped parts which are juxtaposed so as to form approximately symmetrical shapes in the connector left-right direction with respect to the cable center, and the second cable rupturing parts 13*e*, which form cutting-blade shapes, are respectively formed on apex parts projecting downward toward the coaxial cable SC and having approximately chevron shapes in the front side.

The pair of second cable rupturing parts 13*e*, 13*e* are also in an arrangement relation in which the cutting-blade-shaped parts constituting the second cable rupturing parts 13*e* are close to and face the outer-periphery covering material SCd of the coaxial cable SC, which is placed in the cable receiving part 13*c*, from the radial-direction upper side. Then, when the shell cover part 13*b*, which has been pushed down to the approximately horizontal state in the above described manner, covers the cable receiving part 13*c* from the upper side, the pair of second cable rupturing parts 13*e*, 13*e* provided on the shell cover part 13*b* is configured to be pushed down to the lower side while abutting the outer peripheral surface of the coaxial cable SC, in other words, the outer-periphery covering material SCd from the radial-direction outer side (upper side).

In this manner, in the state in which the shell cover part 13*b* is closed, the coaxial cable SC is in the state in which the coaxial cable SC is sandwiched from the upper and lower sides by the first cable rupturing parts 13*d* in the lower side and the second cable rupturing parts 13*e* in the upper side. However, the first and second cable rupturing parts 13*d* and 13*e* are in an arrangement relation in which they are somewhat misaligned from each other in the connector front-rear direction. More specifically, the first cable rupturing parts 13*d* are disposed in somewhat front side compared with the second cable rupturing parts 13*e*. When both of the first and second cable rupturing parts 13*d* and 13*e* bite into the coaxial cable SC in the state in which they are disposed to be mutually misaligned in the connector front-rear direction in this manner, the coaxial cable SC becomes a state in which the coaxial cable SC is deformed with respect to the straight direction which is the original extending direction, and electrical connectivity is configured to be improved by the retention force exerted by the deformed part of the coaxial cable SC.

About Fixation Retaining Plates

On the other hand, first fixation retaining plates 13*b*3 and second fixation retaining plates 13*b*4 consisting of pairs of tongue-shaped members are provided at both-side edge parts of the front cover part 13*b*2, which is continued to the shell cover part 13*b* in the above described manner, so as to form flange plate shapes. Among them, the first fixation retaining plate 13*b*3 is configured to carry out swaging fixation when the first fixation retaining plate 13*b*3 is bent so as to cover the cable receiving part 13*c*, which is covering the coaxial cable SC, from the outer side. The bending deformation of the first fixation retaining plates 13*b*3, 13*b*3 is regulated at the point when the first fixation retaining plates 13*b*3, 13*b*3 are swage-fixed to the cable receiving part 13*c*.

More specifically, the both-side flange plates constituting the pair of first fixation retaining plates 13*b*3, 13*b*3 are disposed at both-side outer positions of the cable receiving part 13*c* when the shell cover part 13*b* is pushed down to the approximately horizontal state, and the swaging fixation is carried out when the flange plates are bent to the connector inner side from such a disposition state (see FIG. 1 to FIG. 7). More specifically, the paired first fixation retaining plates 13*b*3, 13*b*3 are deformed in the direction in which they get close to each other so as to cover the cable receiving part 13*c* from the outer side. When such bending deformation of the first fixation retaining plates 13*b*3, 13*b*3 is carried out, the cutting-blade-shaped parts provided at the apex parts of the first cable rupturing parts 13*d* and the second cable rupturing parts 13*e* are strongly pushed against the outer-periphery covering material SCd of the coaxial cable SC from both of the lower side and the upper side of the radial direction. As a result, the cutting-blade-shaped parts of the first cable rupturing parts 13*d* and the second cable rupturing parts 13*e* enter the inside of the coaxial cable SC so as to rupture the outer-periphery covering material SCd of the coaxial cable SC.

The cutting-blade-shaped parts of the first cable rupturing parts 13*d* and the second cable rupturing parts 13*e*, which have entered the interior of the coaxial cable SC in this manner, further enter the inner side while rupturing the outer-periphery covering material SCd of the coaxial cable SC and, particularly as shown in FIG. 7, reaches the cable outer conductor (shield wire) SCb and obtains a contacted state. As a result, the shield shell 13 is electrically connected to the cable outer conductor (shield wire) SCb via the first cable rupturing parts 13*d* and the second cable rupturing parts 13*e*.

When the bending deformation of the pair of first fixation retaining plates 13*b*3, 13*b*3 is completed to carry out the swaging fixation in the above described manner, the shell cover part 13*b* is fixed to the shell main-body part 13*a*, the coaxial cable SC is fixed to the shell cover part 13*b*, and, furthermore, at the same time, the ground circuit is formed since the cable outer conductor (shield wire) SCb is electrically connected to the shield shell 13 via the first cable rupturing parts 13*d* and the second cable rupturing parts 13*e*.

Furthermore, the second fixation retaining plates 13*b*4 are provided so as to be adjacent and juxtaposed to the front sides of the above described first fixation retaining plates 13*b*3 and are formed by comparatively small flange plates. The second fixation retaining plates 13*b*4 are bent so as to solely cover the outer-periphery covering material SCd of the coaxial cable SC. More specifically, when the shell cover part 13*b* is pushed down to the approximately horizontal state, the both-side flange plates constituting the second fixation retaining plates 13*b*4 are disposed at the positions to which the outer-periphery covering material SCd of the coaxial cable SC is solely extended. In this state, when the flange plates are bent to the connector inner side so as to carry out swaging, the shell cover part 13*b* is fixed to the outer-periphery covering material SCd of the coaxial cable SC.

Figure 21:
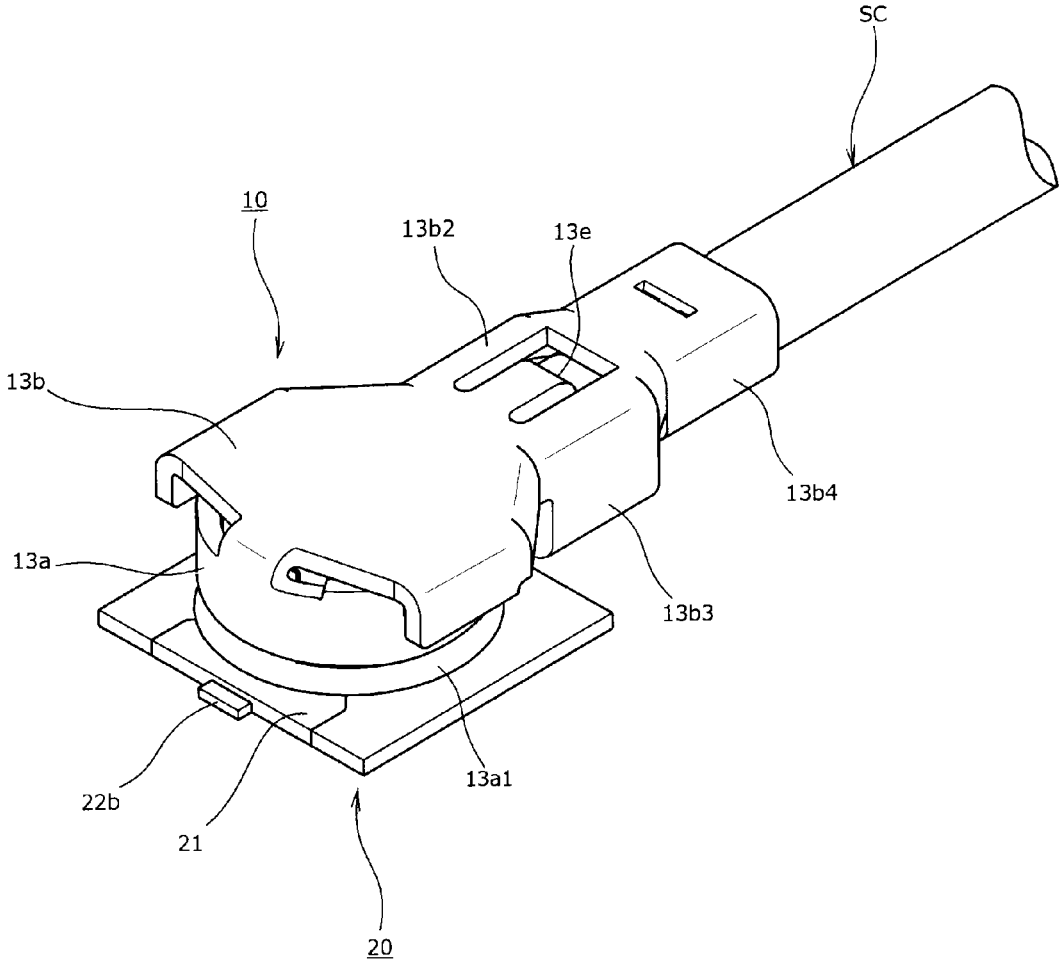
FIG. 21 is an explanatory external perspective view showing, from a back upper side, a coaxial electrical connector device in which the coaxial electrical connector (plug connector) according to the embodiment of the present invention is mated with the counterpart connector (receptacle connector)
Figure 22:
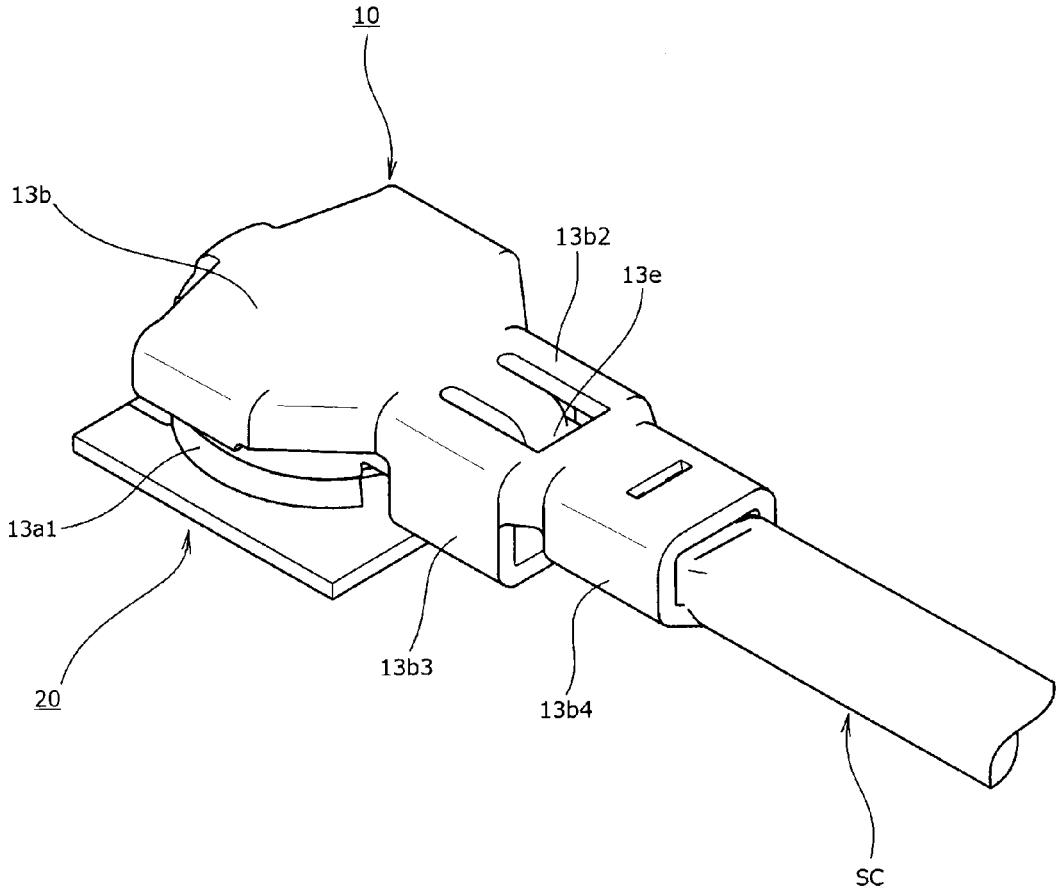
FIG. 22 is an explanatory external perspective view showing, from a front upper side, the coaxial electrical connector device shown in FIG. 21.
Figure 23:
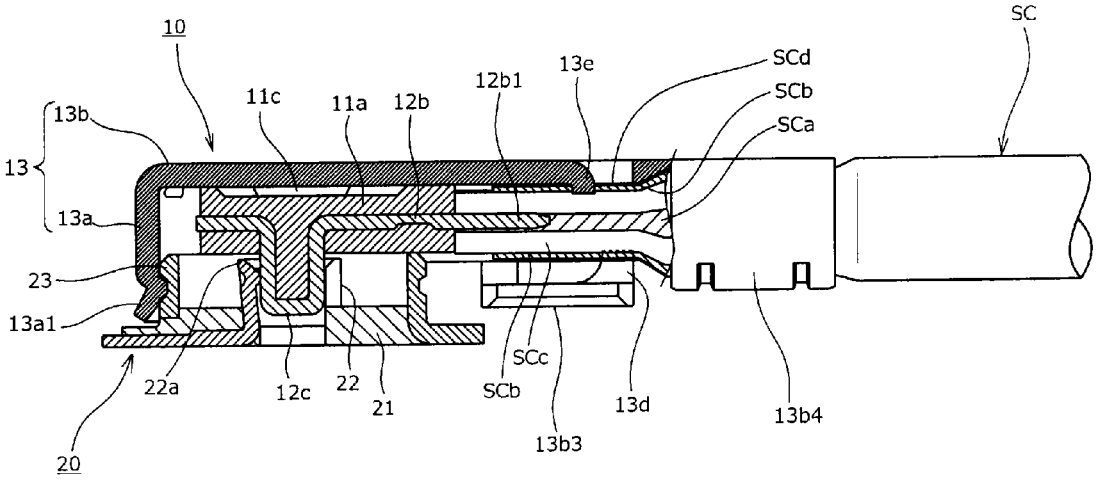
FIG. 23 is an explanatory vertical cross-sectional view of the coaxial electrical connector device shown in FIG. 21 and FIG. 22.

On the other hand, the shell insertion part 13*a*1 constituting the lower-side part of the shell main-body part 13*a* of the shield shell 13 in the above described manner is configured to be externally mated with a radial-direction outer-side part of the receptacle connector 20, which is a mating counterpart (see FIG. 21 to FIG. 23). A coupling engagement part consisting of an annularly recessed groove projecting toward the radial-direction inner side is formed at an inserted-side part of the shell insertion part 13*a*1. The coupling engagement part of the shell insertion part 13*a*1 is configured to be in an elastically mated relation with respect to a coupling latching part provided at the receptacle connector 20, which is the mating counterpart, after the shell cover part 13*b* is pushed down to the approximately horizontal state in the above described manner.

About Counterpart Connector

On the other hand, as shown in FIG. 19 to FIG. 23, the receptacle connector 20, which is the counterpart connector of mating, has an insulating housing 21 consisting of a base-shaped frame, which is placed on the printed wiring board (illustration omitted) and forms an approximately rectangular shape in a plane, a signal contact member 22 for signal transmission is attached to a central part of the insulating housing 21, and a ground contact member 23 for grounding is attached to the signal contact member 22 so as to annularly surround the radial-direction outer side thereof.

About Configuration of Signal Contact Member

The signal contact member 22 is formed by a predetermined thin metal member, the contact connecting part 22*a* forming a hollow cylindrical shape is disposed at a position corresponding to approximately the center of the above described insulating housing 21 so as to be raised to the upper side, and a board connecting leg part 22*b* is extended from a lower end part of the contact connecting part 22*a* toward the outer side. The contact connecting part 12*c*, which is provided in the signal contact member 12 of the above described plug connector 10 so as to form a pin shape, is fitted in the inner side of the contact connecting part 22*a*, which is disposed at the approximately central part of the insulating housing 21, and electrical connection is configured to be established when both of them elastically contact each other.

Moreover, the board connecting leg part 22*b*, which is extending from the contact connecting part 22*a* of the signal contact member 22 in the above described manner, is formed by a band-plate-shaped member extending along the bottom surface of the insulating housing 21 and is projecting from a first edge of the insulating housing 21 toward the outer side. The outer-side projecting part of the board connecting leg part 22*b* or the whole board connecting leg part 22*b* is solder-joined with an electrically-conductive signal path for signal transmission formed on the printed wiring board, which is not shown.

About Ground Contact Member

On the other hand, the ground contact member 23 is also formed by, for example, a bent member of a predetermined thin metal plate, and has a ground main-body part formed so as to form an approximately cylindrical hollow shape, and a ground connecting part 23*a*, which is integrally extending toward the outer side in the radial direction, is provided at a lower edge of an outer peripheral part of the ground main-body part, which forms the annular shape. The ground connecting part 23*a* is solder-joined with each of electrically-conductive ground paths for ground connection formed on the unshown printed wiring board.

According to the present embodiment having such a configuration, when the cable outer conductor (shield wire) SCb of the coaxial cable SC is to be electrically connected to the shield shell 13, electrical connection with respect to the cable outer conductor SCb is established when the first and second cable rupturing parts 13*d* and 13*e* provided on the shell main-body part 13*a* constituting the connector main-body part enter the radial-direction inner side while rupturing the cable outer conductor SCb of the coaxial cable SC. Therefore, the connecting operation is carried out without carrying out the terminal processing of the coaxial cable SC, in other words, the strip process of ripping off the cable dielectric body SCc and the outer-periphery covering material SCd surrounding the cable central conductor (signal wire) SCa and the cable outer conductor (shield wire) SCb, and productivity is improved since the connecting process of the coaxial cable SC with respect to the cable outer conductor SCb is significantly simplified.

Particularly, in the present embodiment, when the shell cover part (ground cover part) 13*b* is to be attached to the shell main-body part 13*a*, the second cable rupturing parts 13*e* provided on the shell cover part 13*b* bite into the coaxial cable SC, and pull-in movement by turning of the shell cover part 13*b* is then carried out; along with this, the coaxial cable SC is pulled toward the connector central side (connector rear side), and electrical connectivity is stabilized as a result.

Moreover, in the present embodiment, both of the first and second cable rupturing parts 13*d* and 13*e* are mutually misaligned in the connector front-rear direction to generate the deformed part in the coaxial cable SC, thereby improving electrical connectivity by the retention force provided by the deformed part of the coaxial cable SC.

Furthermore, according to the present embodiment, when the cable connecting part 12*b* of the signal contact member 12 is to be connected to the cable central conductor (signal wire) SCa of the coaxial cable SC, the process of inserting the cable insertion piece 12*b*1 constituting the cable connecting part 12*b* of the signal contact member 12 thereinto along the cable axial direction of the coaxial cable SC is carried out. Therefore, in addition to simplification of the connecting process with respect to the cable outer conductor (shield wire) SCb of the coaxial cable SC as described above, the connecting process with respect to the cable central conductor (signal wire) SCa is significantly simplified, and the cable connecting part 12*b* of the signal contact member 12 is not moved to cut the cable central conductor (signal wire) SCa in the direction orthogonal to the cable axis. Therefore, the risk of cutting of the cable central conductor (signal wire) SCa, which forms a thin wire shape, is eliminated.

About Second Embodiment

Figure 24:
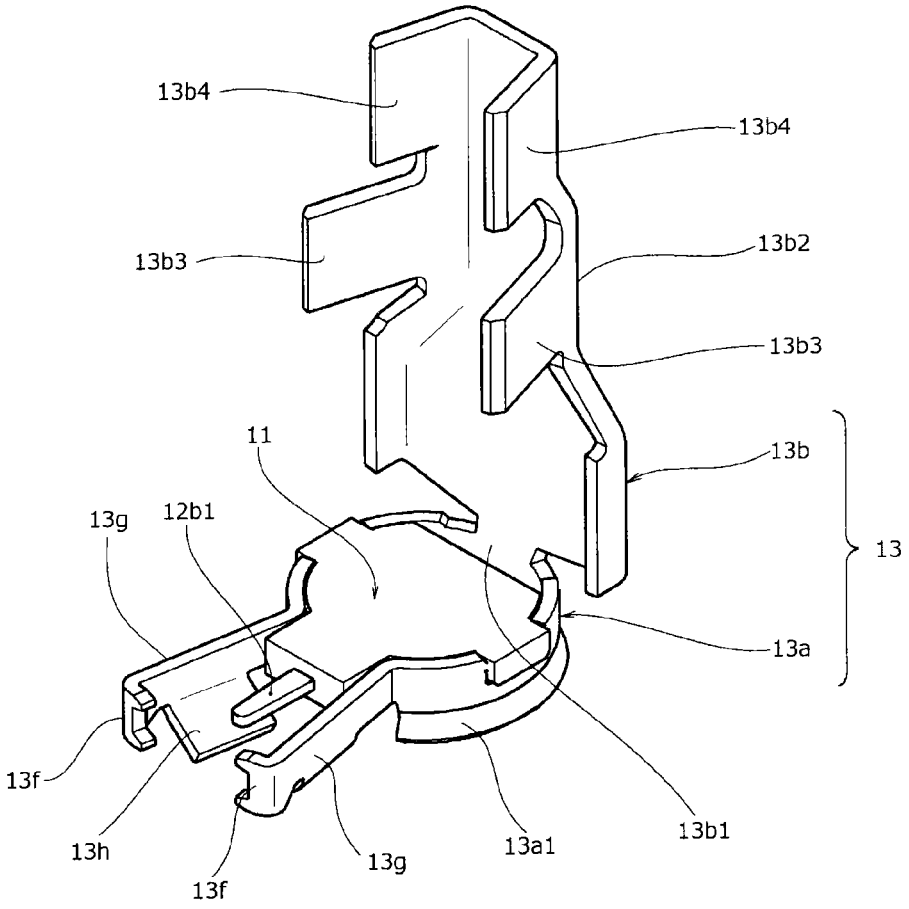
FIG. 24 is an explanatory external perspective view showing, from a front upper side, an initial state before a coaxial cable is coupled to a coaxial electrical connector (plug connector) according to a second embodiment of the present invention.
Figure 25:
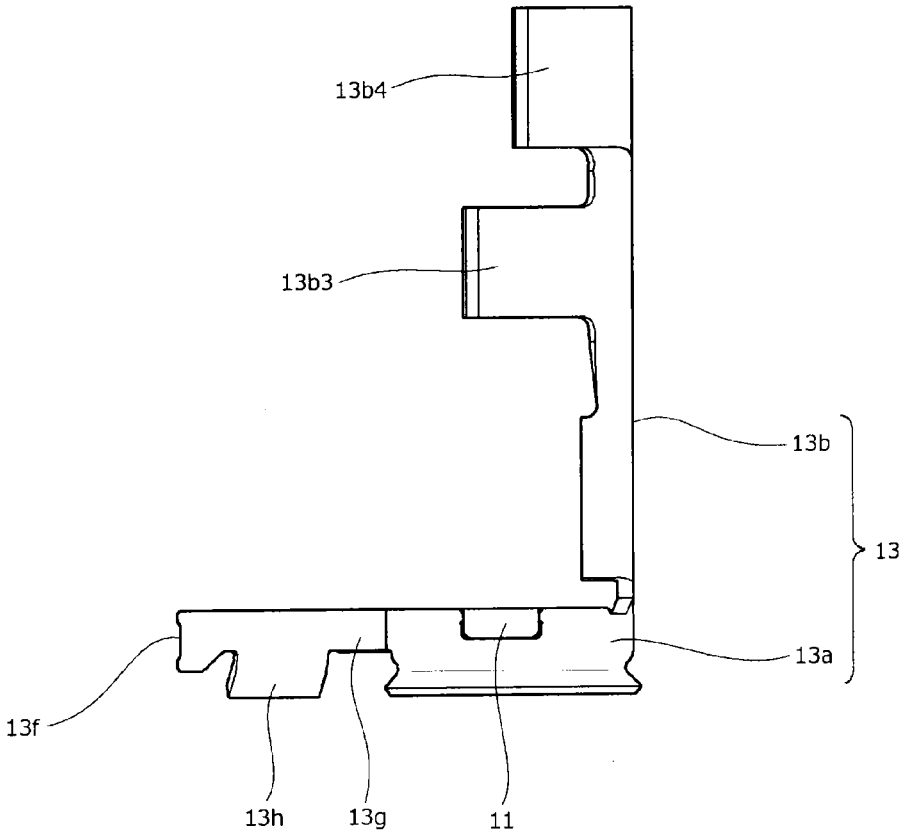
FIG. 25 is an explanatory lateral view of the coaxial electrical connector (plug connector) in the initial state shown in FIG. 24.
Figure 26:
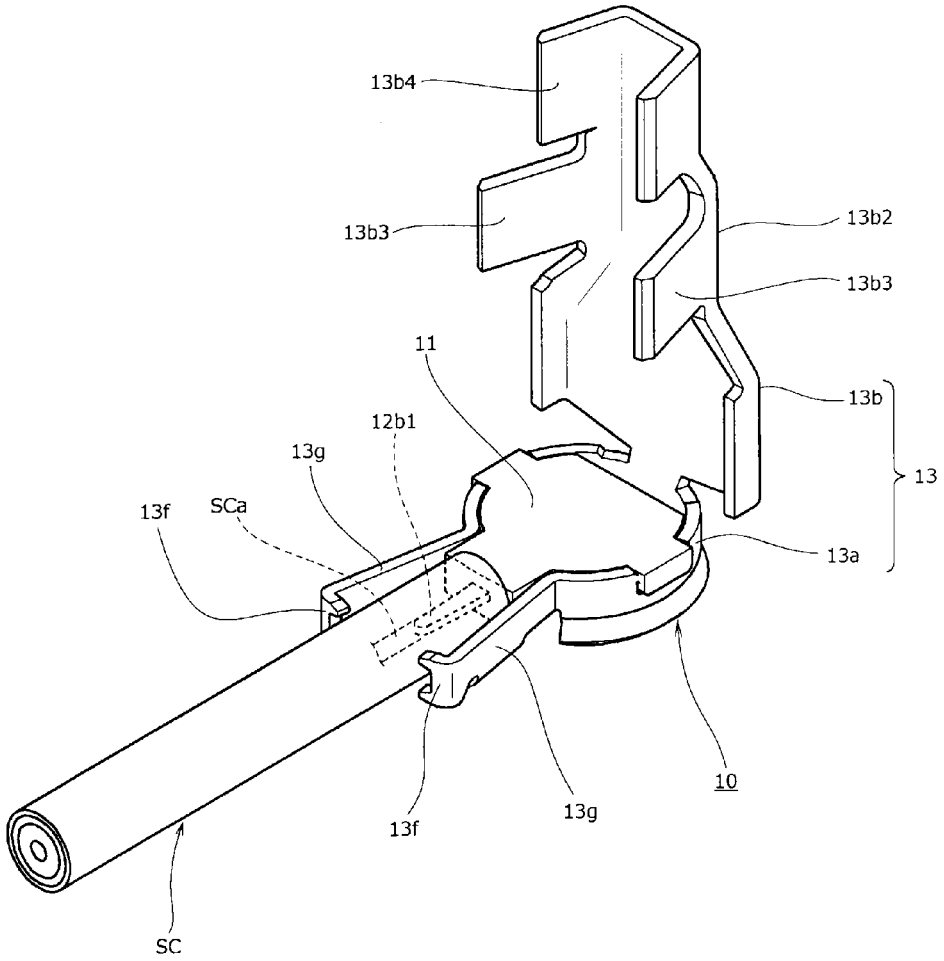
FIG. 26 is an explanatory external perspective view showing, from a front upper side, a set state in which the coaxial cable is coupled to the coaxial electrical connector (plug connector) shown in FIG. 24 and FIG. 25.

On the other hand, in a second embodiment shown in FIG. 24 to FIG. 26, wherein the same constituent members as those of the above described first embodiment are denoted by the same symbols, a pair of horizontal cable rupturing parts 13*f*, 13*f* is disposed so as to sandwich the coaxial cable SC in a horizontal plane.

More specifically, in a front-side part of the shell main-body part 13*a* of the present embodiment, a pair of cable-connecting arm parts 13*g*, 13*g* projecting to the connector front side is provided, and the pair of cable-connecting arm parts 13*g*, 13*g* is configured to be covered from the outer side by the front-side cover part 13*b*2 of the shell cover part 13*b*.

The above described paired cable-connecting arm parts 13*g*, 13*g* are formed by cantilever-shaped beam members, which are projecting approximately horizontally from both sides of the opening provided in the front-side part of the shell main-body part 13*a* toward the connector front side, and the cable-connecting arm parts are extended so that the interval therebetween is gradually increased from the front-side opening of the shell main-body part 13*a* toward the connector front side. In the part between the paired cable-connecting arm parts 13*g*, 13*g*, the cable insertion piece 12*b*1 of the signal contact member 12, which is projecting from the above described insulating main-body part 11*a*, is disposed, and the terminal part of the coaxial cable SC, which is coupled to the cable insertion piece 12*b*1, is disposed (see FIG. 26).

In this manner, the paired cable-connecting arm parts 13*g*, 13*g* are extending along the outer surface of the terminal part of the coaxial cable SC coupled to the cable insertion piece 12*b*1 and is in an arrangement relation in which they sandwich the outer-periphery covering material SCd of the coaxial cable SC from the left-right-direction both sides. Horizontal cable rupturing pieces 13*f*, which form hook-shapes, are formed respectively at the extending-direction distal-end parts of the cable-connecting arm parts 13*g*. Both of the horizontal cable rupturing pieces 13*f*, 13*f* are formed from the distal-end parts of the cable-connecting arm parts 13*g*, 13*g* so as to be bent approximately at a right angle in the inward direction in which they get close to each other, and the horizontal cable rupturing pieces are in an arrangement relation so that claw parts provided to project from the horizontal cable rupturing pieces 13*f*, 13*f* are closely opposed to the outer surface of the coaxial cable SC.

In this case, cable receiving parts 13*h*, 13*h* extending in the direction in which the cable receiving parts are close to each other toward obliquely lower sides are provided at lower-end-side edges of both of the above described cable-connecting arm parts 13*g*, 13*g*. The cable receiving parts 13*h* are extending to the lower side of the terminal part of the coaxial cable SC, which is coupled to the cable insertion piece 12*b*1 of the signal contact member 12 in the above described manner, so that the coaxial cable SC abuts both of the cable receiving parts 13*h*, 13*h* from the upper side and are received thereby.

On the other hand, among the first fixation retaining plates 13*b*3 and the second fixation retaining plates 13*b*4 consisting of the pairs of tongue-shaped members provided at both-side edge parts of the front-side cover part 13*b*2 continued to the shell cover part 13*b* in the above described manner, the first fixation retaining plates 13*b*3 are configured to carry out swaging fixation when the first fixation retaining plates 13*b*3 are bent so as to cover the coaxial cable SC and the cable-connecting arm parts 13*g*.

More specifically, when the shell cover part 13*b* is pushed down to the approximately horizontal state, the both-side flange plates constituting the pair of first fixation retaining plates 13*b*3, 13*b*3 are disposed in the both-side outer positions of the cable-connecting arm parts 13*g*, and swaging fixation is carried out when the flange plates are bent toward the connector inner side from such a disposed state. More specifically, the paired first fixation retaining plates 13*b*3, 13*b*3 are bent and deformed in the direction in which the plates get close to each other so as to cover the cable-connecting arm parts 13*g*, the cable receiving parts 13*h*, and the coaxial cable SC from the outer side. The bending deformation of the first fixation retaining plates 13*b*3 causes the cable-connecting arm parts 13*g* and the cable receiving parts 13*h* to be bent and deformed in the direction in which they get close to the coaxial cable SC. Then, after the claw parts of the horizontal cable rupturing pieces 13*f* provided at the distal-end part of the cable-connecting arm part 13*c* abut the outer-periphery covering material SCd of the coaxial cable SC, the cable-connecting arm parts 13*g*, 13*g* further get close to each other; as a result, the claw parts of the horizontal cable rupturing pieces 13*f* enter the interior of the coaxial cable SC so as to rupture the outer-periphery covering material SCd of the coaxial cable SC.

After the claw parts of the horizontal cable rupturing pieces 13*f*, which have entered the interior of the coaxial cable SC in this manner, pass through the outer-periphery covering material SCd of the coaxial cable SC, the claw parts reach the cable outer conductor (shield wire) SCb and obtains a contacted state. As a result, the shield shell 13 is ground-connected to the cable outer conductor (shield wire) SCb via the horizontal cable rupturing pieces 13*f* and the cable-connecting arm parts 13*g*.

Moreover, when the first fixation retaining plates 13*b*3, 13*b*3 are bent toward the connector inner side in the above described manner to carry out swaging fixation, the cable receiving parts 13*h*, 13*h* are bent and deformed together with the first fixation retaining plates 13*b*3, 13*b*3 so as to be close to each other and press the outer-periphery covering material SCd of the coaxial cable SC. Then, when both of the cable receiving parts 13*h*, 13*h* reach a mutually abutting state, the bending deformation of the first fixation retaining plates 13*b*3, 13*b*3 is regulated so that excessive deformation of the first fixation retaining plates 13*b*3, 13*b*3 is reliably prevented.

According to the second embodiment having such a configuration, when the shield shell (ground contact member) 13 is to be connected to the cable outer conductor (shield wire) SCb of the coaxial cable SC, the paired cable-connecting arm parts 13*g*, 13*g* are deformed so as to get close to each other in the state in which the terminal part of the coaxial cable SC is disposed between the paired cable-connecting arm parts 13*g*, 13*g*. As a result, the horizontal cable rupturing pieces 13*f* are pushed from the outer side of the coaxial cable SC so that the connecting process of the shield shell (ground contact member) 13 with respect to the cable outer conductor (shield wire) SCb of the coaxial cable SC is easily and efficiently carried out without carrying out the strip process of ripping off the outer-periphery covering material SCd surrounding the cable outer conductor (shield wire) SCb of the coaxial cable SC.

The bending deformation of the cable-connecting arm parts 13*g*, 13*g* in this case is efficiently and easily carried out by bending and deforming the pair of first fixation retaining plates 13*b*3, 13*b*3 provided on the shell cover part 13*b*, and the cable-connecting arm parts 13*g*, 13*g* are firmly fastened from the outer side by the bending/deforming force of the first fixation retaining plates 13*b*3, 13*b*3. As a result, the shield shell 13 serving as the ground contact member and the cable outer conductor (shield wire) SCb of the coaxial cable SC are connected well with each other. Moreover, the fastening force by the first fixation retaining plates 13*b*3, 13*b*3 in this process also presses peripheral parts of the cable insertion piece 12*b*1, which is in a connected state with the cable central conductor (signal wire) SCa of the coaxial cable SC. Therefore, the cable insertion piece 12*b*1 and the cable central conductor (signal wire) SCa are also connected well with each other.

Moreover, since the connection of the shield shell (ground contact member) 13 is carried out while the terminal part of the coaxial cable SC is in contact with and retained by the cable receiving parts 13*h*, the connection of the shield shell (ground contact member) 13 with respect to the cable outer conductor (shield wire) SCb of the coaxial cable SC is stably carried out.

Figure 27:
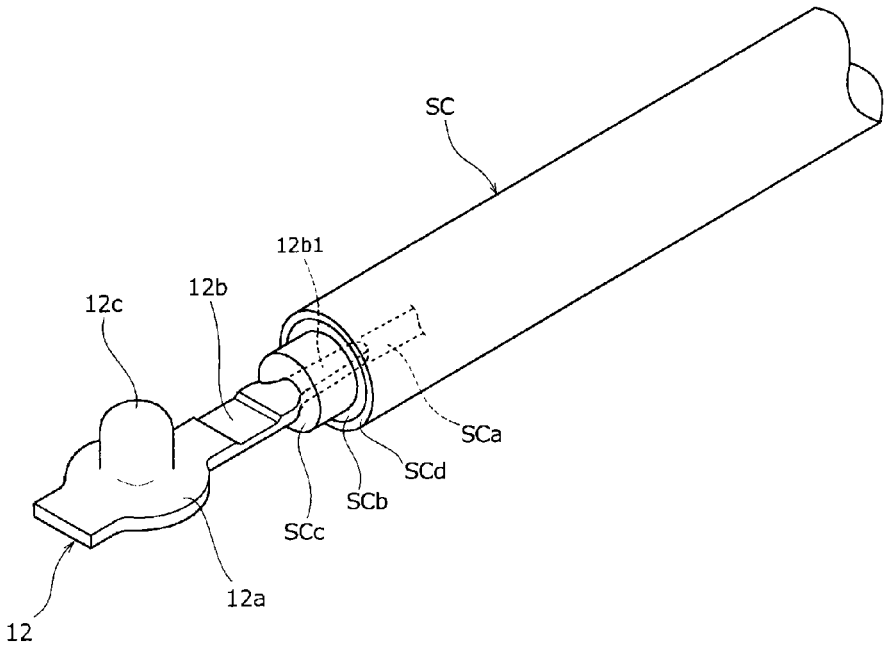
FIG. 27 is an explanatory external perspective view showing a state in which a cable connecting part of a signal contact is inserted to another embodiment of a coaxial cable according to the present invention.
Figure 28:
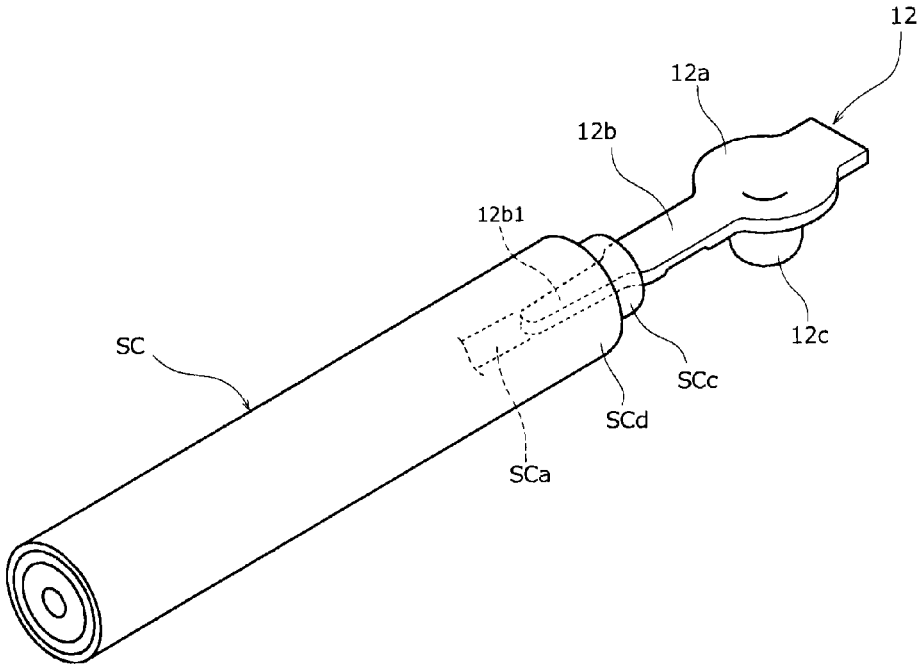
FIG. 28 is an explanatory external perspective view showing the coaxial cable in which the cable connecting part of the signal contact shown in FIG. 27 is inserted.

On the other hand, in an embodiment shown in FIG. 27 and FIG. 28 in which the same constituent members as those of the second embodiment are denoted by the same symbols, when the terminal part of the coaxial cable SC is to be coupled to the plug connector 10, the terminal processing with respect to the coaxial cable SC is partially carried out. More specifically, in the present embodiment, rip-off (peel-off) with respect to the terminal part of the outer-periphery covering material SCd and the cable outer conductor (shield wire) SCb is carried out so that the cable dielectric body SCc stacked in the outer peripheral side of the cable central conductor (signal wire) Sca is exposed to the outer side. When such a process is carried out, when the cable insertion piece 12*b*1 of the signal contact member 12 is to be inserted into the coaxial cable SC, since the cable outer conductor (shield wire) SCb has been ripped off from the coaxial cable SC, the risk of contact of the cable insertion piece 12*b*1 with the cable outer conductor (shield wire) SCb is eliminated, and short-circuiting, etc. in electrical connection processes are reliably avoided.

Hereinabove, the invention accomplished by the present inventors has been explained in detail based on the embodiments. However, the present embodiments are not limited to the above described embodiments, and it goes without saying that various modifications can be made within the range not departing from the gist thereof.

For example, in the above described embodiments, the present invention is applied to electrical connectors of a vertical mating type. However, the present invention can be similarly applied to electrical connectors of a horizontal mating type.

Furthermore, the present invention is not limited to a connector for a single-core coaxial cable like the above described embodiments, and the present invention can be similarly applied to a connector for a coaxial cable disposed in a multipolar manner, an electrical connector of a type in which a plurality of coaxial cables and insulating cables are mixed, etc.

As described above, the present embodiments can be widely applied to various electrical connectors used in various electrical equipment.

What is claimed is:

1. A coaxial electrical connector for establishing electrical connection by placing and fixing a coaxial cable on/to a connector main-body part, the coaxial cable being formed so as to surround, from an outer side by an outer-periphery covering material, an outer conductor concentrically disposed with respect to a central conductor, the coaxial electrical connector comprising:

the connector main-body part, which is provided with a shell main-body part that houses an insulating housing and a shell cover part attached to the shell main-body part so as to cover the shell main-body part;

cable rupturing parts projecting from a radial-direction outer side of the coaxial cable placed on the connector main-body part toward an inner side are provided on the connector main-body part; and a pair of the cable rupturing parts is disposed so as to sandwich the coaxial cable from radial-direction from both sides, wherein the cable rupturing parts are configured to rupture the outer-periphery covering material and be electrically connected to the outer conductor when the pair of cable rupturing parts are pushed to a radial-direction inner side toward the coaxial cable, the shell main-body part is provided with a cable receiving part on which the coaxial cable is placed, a first one of the pair of cable rupturing parts is provided on the cable receiving part, and a second one of the pair of cable rupturing parts is provided on the shell cover part, the shell cover part is provided with a fixation retaining part sandwiching the coaxial cable placed on the cable receiving part, and at least part of the fixation retaining part is swage-fixed to the cable receiving part.

2. The coaxial electrical connector according to claim 1, wherein the first one and the second one of the pair of cable rupturing parts are disposed to be mutually misaligned in an extending direction of the coaxial cable.

3. The coaxial electrical connector according to claim 1, wherein a signal contact member and a ground contact member respectively connected to the central conductor and the outer conductor of the coaxial cable are attached to the insulating housing so as to form an approximately concentric shape;

the signal contact member is provided with a cable connecting part connected to the central conductor of the coaxial cable and provided with a contact connecting part connected to a signal contact member of a mating counterpart connector;

the cable connecting part of the signal contact member has a cable insertion piece inserted in from an end face of a terminal part of the coaxial cable along a direction of a cable axis serving as an extending direction of the coaxial cable; and a distal-end-side part in the direction of inserting the cable insertion piece is configured to be electrically connected to the central conductor in the coaxial cable.

4. A coaxial electrical connector for establishing electrical connection by placing and fixing a coaxial cable on/to a connector main-body part, the coaxial cable being formed so as to surround, from an outer side by an outer-periphery covering material, an outer conductor concentrically disposed with respect to a central conductor, the coaxial electrical connector comprising:

the connector main-body part, which is provided with a shell main-body part that houses an insulating housing and a shell cover part attached to the shell main-body part so as to cover the shell main-body part;

the shell main-body part, which is provided with a pair of cable-connecting arm parts projecting from the shell main-body part in an extending direction of the coaxial cable, each of the cable-connecting arm parts being provided with a cable receiving part on which the coaxial cable is placed;

a cable rupturing part provided in each of the paired cable-connecting arm parts respectively, wherein the cable rupturing parts project from a radial-direction outer side of the coaxial cable placed between the paired cable-connecting arm parts toward an inner side, the cable rupturing part is configured to rupture the outer-periphery covering material and be electrically connected to the outer conductor when the pair of cable rupturing parts is pushed to a radial-direction inner side toward the coaxial cable, the shell cover part is provided with a fixation retaining part sandwiching the coaxial cable placed on the cable receiving part, and at least part of the fixation retaining part is swage-fixed to the cable receiving part.

* * * * *